US009412385B2

(12) United States Patent
Sen et al.

(10) Patent No.: US 9,412,385 B2
(45) Date of Patent: Aug. 9, 2016

(54) PERFORMING SPATIAL MASKING WITH RESPECT TO SPHERICAL HARMONIC COEFFICIENTS

(71) Applicant: QUALCOMM Incorporated, San Diego, CA (US)

(72) Inventors: Dipanjan Sen, San Diego, CA (US); Martin James Morrell, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 149 days.

(21) Appl. No.: 14/288,219

(22) Filed: May 27, 2014

(65) Prior Publication Data

US 2014/0355768 A1 Dec. 4, 2014

Related U.S. Application Data

(60) Provisional application No. 61/828,132, filed on May 28, 2013.

(51) Int. Cl.
*G10L 19/008* (2013.01)
*H04R 5/00* (2006.01)
*G10L 19/02* (2013.01)

(52) U.S. Cl.
CPC ..... *G10L 19/008* (2013.01); *G10L 19/0212* (2013.01)

(58) Field of Classification Search
None
See application file for complete search history.

(56) References Cited

U.S. PATENT DOCUMENTS

2003/0187634 A1* 10/2003 Li ..... G10L 19/02 704/200.1
2008/0052089 A1* 2/2008 Takagi ..... G10L 19/008 704/503

(Continued)

FOREIGN PATENT DOCUMENTS

EP 2469741 A1 6/2012
WO 2009067741 A1 6/2009

OTHER PUBLICATIONS

Kropp H., et al., "Format-Agnostic Approach for 3D Audio", International Broadcasting Conference 2012; Sep. 9, 2012-Sep. 17, 2012; Amsterdam, Sep. 12, 2012, pp. 1-9, XP030082402.

(Continued)

*Primary Examiner* — Thang Tran
(74) *Attorney, Agent, or Firm* — Shumaker & Sieffert, P.A.

(57) ABSTRACT

In general, techniques are described by which to perform spatial masking with respect to spherical harmonic coefficients. As one example, an audio encoding device comprising a processor may perform various aspects of the techniques. The processor may be configured to perform spatial analysis based on the spherical harmonic coefficients describing a three-dimensional sound field to identify a spatial masking threshold. The processor may further be configured to render the multi-channel audio data from the plurality of spherical harmonic coefficients, and compress the multi-channel audio data based on the identified spatial masking threshold to generate a bitstream.

48 Claims, 16 Drawing Sheets

(56) References Cited

U.S. PATENT DOCUMENTS

| | | | | |
|---|---|---|---|---|
| 2009/0248425 | A1* | 10/2009 | Vetterli | G10L 19/008 704/503 |
| 2012/0155653 | A1* | 6/2012 | Jax | G10L 19/008 381/22 |
| 2013/0216070 | A1* | 8/2013 | Keiler | H04R 5/02 381/300 |
| 2014/0219455 | A1* | 8/2014 | Peters | H04S 5/00 381/17 |
| 2014/0219456 | A1* | 8/2014 | Morrell | H04S 5/00 381/17 |
| 2014/0247946 | A1* | 9/2014 | Sen | G10L 19/167 381/23 |
| 2015/0131800 | A1* | 5/2015 | Mundt | H04S 3/008 381/22 |
| 2015/0269950 | A1* | 9/2015 | Schug | G10L 19/008 704/501 |
| 2016/0088415 | A1* | 3/2016 | Krueger | G10L 19/008 381/22 |

OTHER PUBLICATIONS

Pallone G., et al., "Proposed modifications to Draft Call for Proposals for 3D Audio", 101. MPEG Meeting; Jul. 16, 2012-Jul. 20, 2012; Stockholm; (Motion Picture Expert Group or ISO/IEC JTC1/SC29/WG11), No. m25979, Jul. 11, 2012, pp. 1-13, XP030054314.

Second Written Opinion from International Application No. PCT/US2014/039860, dated Nov. 2, 2015, 7 pp.

Response to Second Written Opinion dated Nov. 2, 2015, from International Application No. PCT/US2014/039860, filed on Feb. 2, 2016, 7 pp.

Daniel, et al., "Spatial Auditory Blurring and Applications to Multichannel Audio Coding", XP055104301, Retrieved from the Internet: URL:http://tel.archives-ouvertes.fr/tel-00623670/en/, Jun. 23, 2011, 173 pp. [uploaded in parts].

Hu, et al., "Perceptual Characteristic and Compression Research in 3D Audio Technology", Lecture Notes in Computer Science (LNCS), Springer Verlag, DE, XP047041234, ISSN: 0302-9743, Jun. 19, 2012, pp. 82-98.

Zotter, et al., "The Virtual T-Design Ambisonics-Rig Using VBAP," Sep. 15-18, 2010, Congress on Sound and Vibration, 4 pp.

International Search Report and Written Opinion from International Application No. PCT/US2014/039860, dated Oct. 2, 2014, 11 pp.

Response to Written Opinion dated Oct. 2, 2014, from International Application No. PCT/US2014/039860, filed on Mar. 27, 2015, 6 pp.

Second Written Opinion from International Application No. PCT/US2014/039860, dated Apr. 4, 2016, 7 pp.

Response to Second Written Opinion dated Apr. 4, 2016 from International Application No. PCT/US2014/039860, filed on Jun. 3, 2016, 5 pp.

* cited by examiner

PERFORMING SPATIAL MASKING WITH RESPECT TO SPHERICAL HARMONIC COEFFICIENTS

This application claims the benefit of U.S. Provisional Application No. 61/828,132, filed May 28, 2013.

TECHNICAL FIELD

The techniques relates to audio data and, more specifically, coding of audio data.

BACKGROUND

A higher order ambisonics (HOA) signal (often represented by a plurality of spherical harmonic coefficients (SHC) or other hierarchical elements) is a three-dimensional representation of a sound field. This HOA or SHC representation may represent this sound field in a manner that is independent of the local speaker geometry used to playback a multi-channel audio signal rendered from this SHC signal. This SHC signal may also facilitate backwards compatibility as this SHC signal may be rendered to well-known and highly adopted multi-channel formats, such as a 5.1 audio channel format or a 7.1 audio channel format. The SHC representation may therefore enable a better representation of a sound field that also accommodates backward compatibility.

SUMMARY

In general, techniques are described for performing spatial masking with respect to the spherical harmonic coefficients (which may also be referred to as higher-order ambisonic (HOA) coefficients). Spatial masking may leverage the inability of the human auditory system in detecting a quieter sound when a relatively louder sound occurs in a spatially proximate location to the quieter sound. The techniques described in this disclosure may enable an audio coding device to evaluating a soundfield expressed by the spherical harmonic coefficients to identify these quieter (or less energetic) sounds that may be masked by relatively louder (or more energetic) sounds. The audio coding device may then assign more bits for coding the quieter sounds while assigning more bits (or maintaining a number of bits) for coding the louder sounds. In this respect, the techniques described in this disclosure may facilitate coding of the spherical harmonic coefficients.

In one aspect, a method comprises decoding a bitstream to generate first multi-channel audio data having a plurality of channels corresponding to speakers arranged in a defined speaker geometry, performing an inverse rendering process with respect to the generated multi-channel audio data to generate a plurality of spherical harmonic coefficients, and rendering second multi-channel audio data having a plurality of channels corresponding to speakers arranged in a local speaker geometry based on the plurality of spherical harmonic coefficients.

In another aspect, an audio decoding device comprises one or more processors configured to decode a bitstream to generate first multi-channel audio data having a plurality of channels corresponding to speakers arranged in a first speaker geometry, perform an inverse rendering process with respect to the generated multi-channel audio data to generate a plurality of spherical harmonic coefficients, and render second multi-channel audio data having a plurality of channels corresponding to speakers arranged in a local speaker geometry based on the plurality of spherical harmonic coefficients.

In another aspect, an audio decoding device comprises means for decoding a bitstream to generate first multi-channel audio data having a plurality of channels corresponding to speakers arranged in a first speaker geometry, means for performing an inverse rendering process with respect to the generated multi-channel audio data to generate a plurality of spherical harmonic coefficients, and means for rendering second multi-channel audio data having a plurality of channels corresponding to speakers arranged in a local speaker geometry based on the plurality of spherical harmonic coefficients.

In another aspect, a non-transitory computer-readable storage medium has stored thereon instructions that, when executed, cause one or more processors of an audio decoding device to decode a bitstream to generate first multi-channel audio data having a plurality of channels corresponding to speakers arranged in a first speaker geometry, perform an inverse rendering process with respect to the generated multi-channel audio data to generate a plurality of spherical harmonic coefficients, and render second multi-channel audio data having a plurality of channels corresponding to speakers arranged in a local speaker geometry based on the plurality of spherical harmonic coefficients.

In another aspect, a method of compressing audio data comprises performing spatial analysis based on a plurality of spherical harmonic coefficients that describe a three-dimensional sound field to identify a spatial masking threshold, and compressing the audio data based on the identified spatial masking thresholds to generate a bitstream.

In another aspect, a device comprises one or more processors configured to perform spatial analysis based on a plurality of spherical harmonic coefficients that describe a three-dimensional sound field to identify a spatial masking threshold and compress the audio data based on the identified spatial masking thresholds to generate a bitstream.

In another aspect, a device comprises means for performing spatial analysis based on a plurality of spherical harmonic coefficients that describe a three-dimensional sound field to identify a spatial masking threshold, and means for compressing the audio data based on the identified spatial masking thresholds to generate a bitstream.

In another aspect, a non-transitory computer-readable storage medium has stored thereon instructions that, when executed, cause one or more processors to perform spatial analysis based on a plurality of spherical harmonic coefficients that describe a three-dimensional sound field to identify a spatial masking threshold, and compress the audio data based on the identified spatial masking thresholds to generate a bitstream.

In another aspect, a method of compressing audio comprises rendering a plurality of spherical harmonic coefficients that describe a sound field of the audio in three dimensions to generate multi-channel audio data, performing spatial analysis with respect to the multi-channel audio data to identify a spatial masking threshold, and compressing the multi-channel audio data based on the identified spatial masking threshold to generate a bitstream.

In another aspect, a device comprises one or more processors configured to render a plurality of spherical harmonic coefficients that describe a sound field of the audio in three dimensions to generate multi-channel audio data, perform spatial analysis with respect to the multi-channel audio data to identify a spatial masking threshold, and compress the multi-channel audio data based on the identified spatial masking threshold to generate a bitstream.

In another aspect, a device comprises means for rendering a plurality of spherical harmonic coefficients that describe a sound field of the audio in three dimensions to generate multichannel audio data, means for performing spatial analysis with respect to the multi-channel audio data to identify a spatial masking threshold, and means for compressing the multi-channel audio data based on the identified spatial masking threshold to generate a bitstream.

In another aspect, a non-transitory computer-readable storage medium has stored thereon instructions that, when executed, cause one or more processors to render a plurality of spherical harmonic coefficients that describe a sound field of the audio in three dimensions to generate multi-channel audio data, perform spatial analysis with respect to the multi-channel audio data to identify a spatial masking threshold, and compress the multi-channel audio data based on the identified spatial masking threshold to generate a bitstream.

In another aspect, a method of compressing audio data comprises determining a target bitrate for a bitstream representative of the compressed audio data, performing spatial analysis based on a plurality of spherical harmonic coefficients that describe a sound field of the audio data in three dimensions to identify a spatial masking threshold, and performing, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

In another aspect, a device comprises one or more processors configured to determine a target bitrate for a bitstream representative of the compressed audio data, perform spatial analysis based on a plurality of spherical harmonic coefficients that describe a sound field of the audio data in three dimensions to identify a spatial masking threshold, and perform, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

In another aspect, a device comprises means for determining a target bitrate for a bitstream representative of the compressed audio data, means for performing spatial analysis based on a plurality of spherical harmonic coefficients that describe a sound field of the audio data in three dimensions to identify a spatial masking threshold, and means for performing, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

In another aspect, a non-transitory computer-readable storage medium has stored thereon instructions that, when executed, cause one or more processors to determine a target bitrate for a bitstream representative of the compressed audio data, perform spatial analysis based on a plurality of spherical harmonic coefficients that describe a sound field of the audio data in three dimensions to identify a spatial masking threshold, and perform, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

In another aspect, a method of compressing multi-channel audio data, the method comprises performing spatial analysis based on a plurality of spherical harmonic coefficients that describe a sound field of the multi-channel audio data in three dimensions to identify a spatial masking threshold, rendering the spherical harmonic coefficients to generate the multi-channel audio data, performing spatial masking with respect to one or more base channels of the multi-channel audio data using the spatial masking threshold, and performing parametric inter-channel audio encoding with respect to the multi-channel audio data, including the spatially masked one or more base channels of the multi-channel audio data, to generate a bitstream.

In another aspect, a device comprises one or more processors to perform spatial analysis based on a plurality of spherical harmonic coefficients that describe a sound field of the multi-channel audio data in three dimensions to identify a spatial masking threshold, render the spherical harmonic coefficients to generate the multi-channel audio data, perform spatial masking with respect to one or more base channels of the multi-channel audio data using the spatial masking threshold, and perform parametric inter-channel audio encoding with respect to the multi-channel audio data, including the spatially masked one or more base channels of the multi-channel audio data, to generate a bitstream.

In another aspect, a device comprises means for performing spatial analysis based on a plurality of spherical harmonic coefficients that describe a sound field of the multi-channel audio data in three dimensions to identify a spatial masking threshold, means for rendering the spherical harmonic coefficients to generate the multi-channel audio data, means for performing spatial masking with respect to one or more base channels of the multi-channel audio data using the spatial masking threshold, and means for performing parametric inter-channel audio encoding with respect to the multi-channel audio data, including the spatially masked one or more base channels of the multi-channel audio data, to generate a bitstream.

In another aspect, a non-transitory computer-readable storage medium has stored thereon instructions that, when executed, cause one or more processors to perform spatial analysis based on a plurality of spherical harmonic coefficients that describe a sound field of the multi-channel audio data in three dimensions to identify a spatial masking threshold, render the spherical harmonic coefficients to generate the multi-channel audio data, perform spatial masking with respect to one or more base channels of the multi-channel audio data using the spatial masking threshold, and perform parametric inter-channel audio encoding with respect to the multi-channel audio data, including the spatially masked one or more base channels of the multi-channel audio data, to generate a bitstream.

In another aspect, a method of compressing audio data, the method comprises performing spatial analysis based on a plurality of spherical harmonic coefficients that describe a sound field of the audio data in three dimensions to identify a spatial masking threshold, performing spatial masking with respect to the plurality of spherical harmonic coefficients using the spatial masking threshold, and generating a bitstream that includes the plurality of spatially masked spherical harmonic coefficients.

In another aspect, a device comprises one or more processors to perform spatial analysis based on a plurality of spherical harmonic coefficients that describe a sound field of the audio data in three dimensions to identify a spatial masking threshold, perform spatial masking with respect to the plurality of spherical harmonic coefficients using the spatial masking threshold, and generate a bitstream that includes the plurality of spatially masked spherical harmonic coefficients.

In another aspect, a device comprises means for performing spatial analysis based on a plurality of spherical harmonic coefficients that describe a sound field of the audio data in three dimensions to identify a spatial masking threshold, means for performing spatial masking with respect to the plurality of spherical harmonic coefficients using the spatial masking threshold, and means for generating a bitstream that includes the plurality of spatially masked spherical harmonic coefficients.

In another aspect, a non-transitory computer-readable storage medium has stored thereon instructions that, when executed, cause one or more processors to perform spatial analysis based on a plurality of spherical harmonic coefficients that describe a sound field of the audio data in three dimensions to identify a spatial masking threshold, perform spatial masking with respect to the plurality of spherical harmonic coefficients using the spatial masking threshold, and generate a bitstream that includes the plurality of spatially masked spherical harmonic coefficients.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
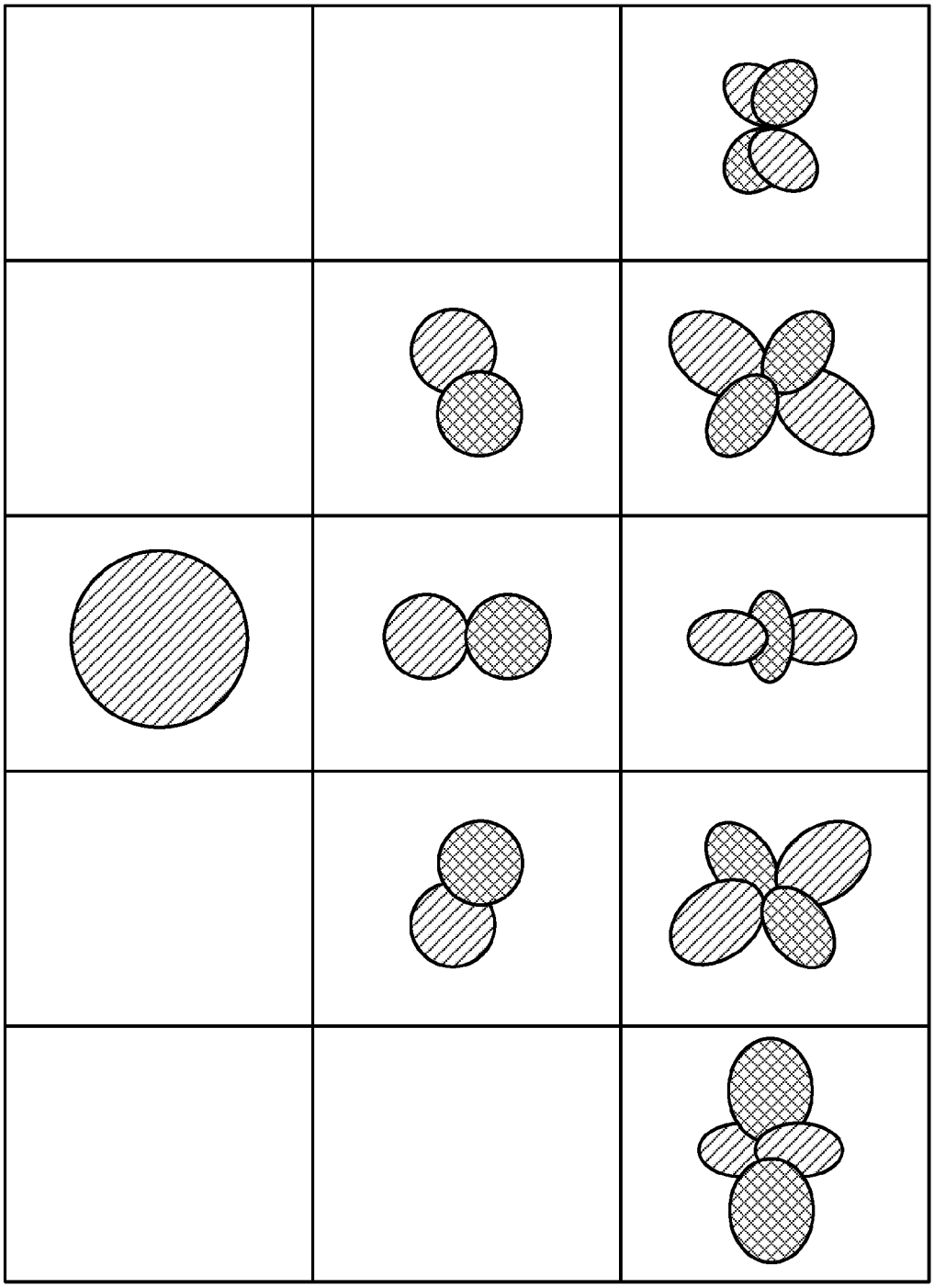
FIGS. 1-3 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Further examples include formats for a spherical harmonic array.

The input to the future MPEG encoder is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of SHC. The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r, \theta_r, \phi_r\}$ of the sound field can be represented uniquely by the SHC $A_n^m(k)$. Here, $$k = \frac{\omega}{c},$$

c is the speed of sound (~343 m/s), $\{r_r, \theta_r, \phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega, r_r, \theta_r, \phi_r)$) which can be approximated by various time-frequency transformations, such as the discrete Fourier transform (DFT), the discrete cosine transform (DCT), or a wavelet transform.

Other examples of hierarchical sets include sets of wavelet transform coefficients and other sets of coefficients of multi-resolution basis functions.

FIG. 1 is a diagram illustrating a zero-order spherical harmonic basis function (first row), first-order spherical harmonic basis functions (second row) and second-order spherical harmonic basis functions (third row). The order (n) is identified by the rows of the table with the first row referring to the zero order, the second row referring to the first order and third row referring to the second order. The sub-order (m) is identified by the columns of the table, which are shown in more detail in FIG. 3. The SHC corresponding to zero-order spherical harmonic basis function may be considered as specifying the energy of the sound field, while the SHCs corresponding to the remaining higher-order spherical harmonic basis functions may specify the direction of that energy.

Figure 2:
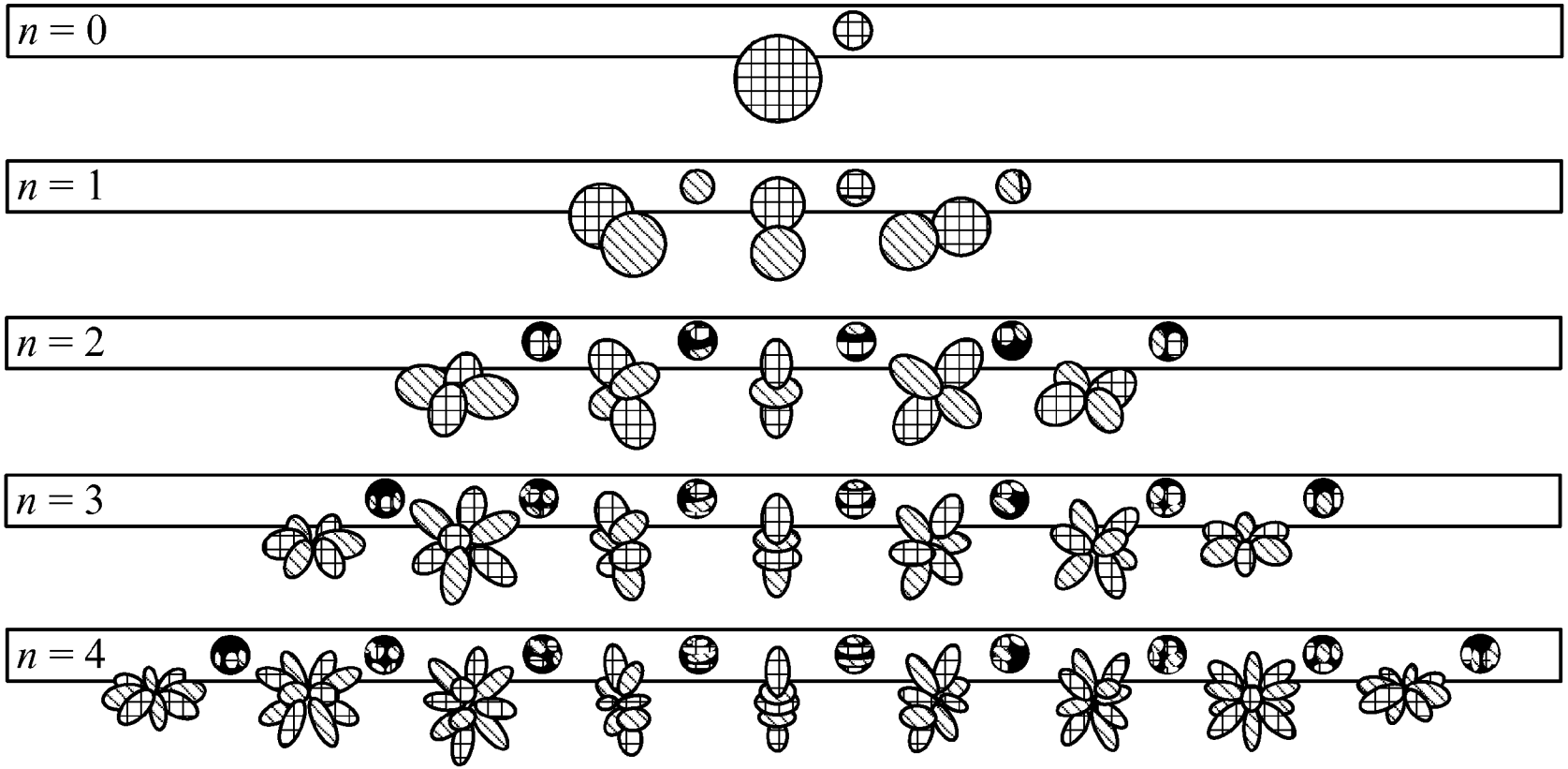

FIG. 2 is a diagram illustrating spherical harmonic basis functions from the zero order (n=0) to the fourth order (n=4). As can be seen, for each order, there is an expansion of suborders m which are shown but not explicitly noted in the example of FIG. 2 for ease of illustration purposes.

Figure 3:
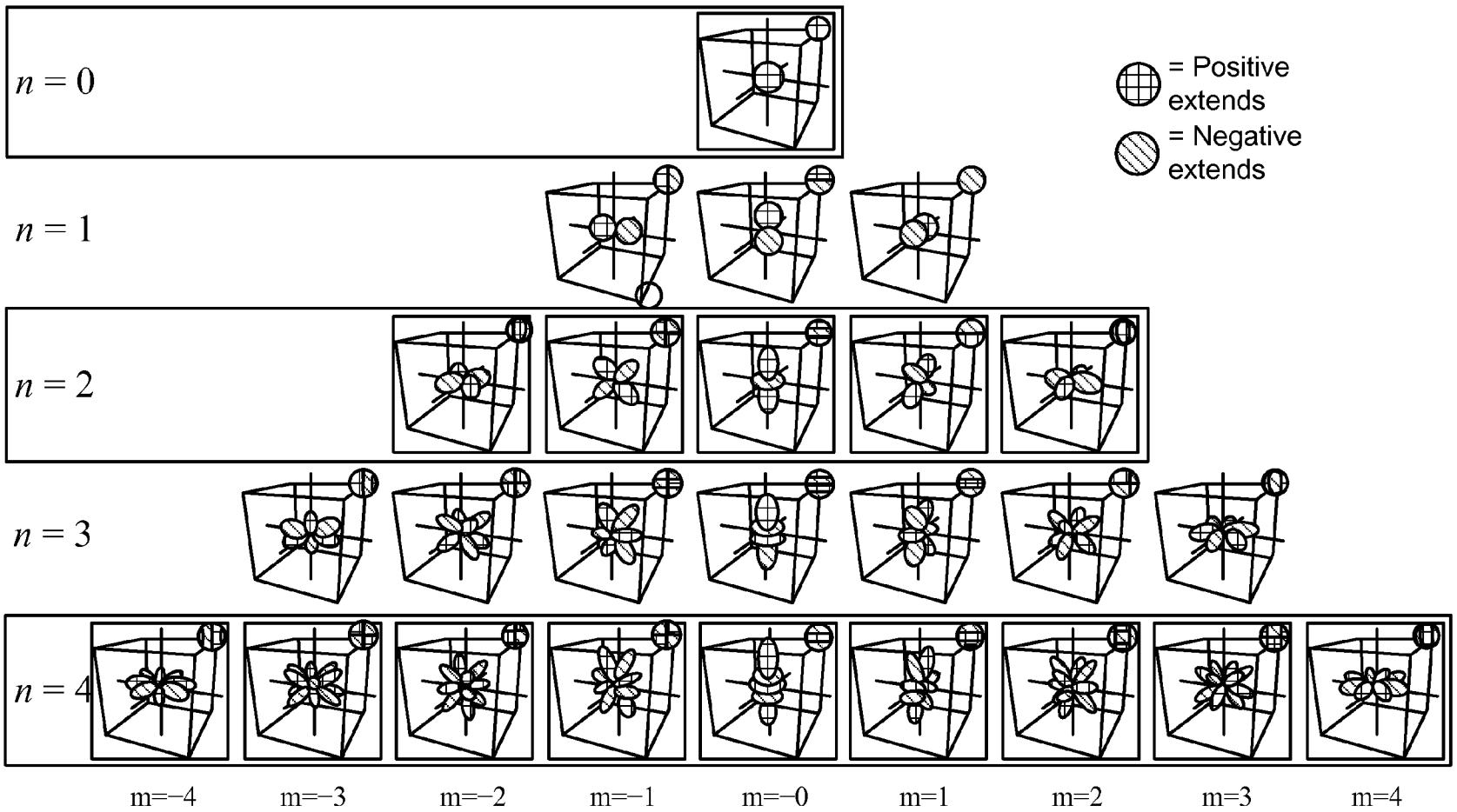

FIG. 3 is another diagram illustrating spherical harmonic basis functions from the zero order (n=0) to the fourth order (n=4). In FIG. 3, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The former represents scene-based audio input to an encoder. For example, a fourth-order representation involving $1+2^4$ (25, and hence fourth order) coefficients may be used. To illustrate how these SHCs may be derived from an object-based description, consider the following equation. The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s, \theta_s, \phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r, \theta_r, \phi_r\}$. The remaining figures are described below in the context of object-based and SHC-based audio coding.

Figure 4A:
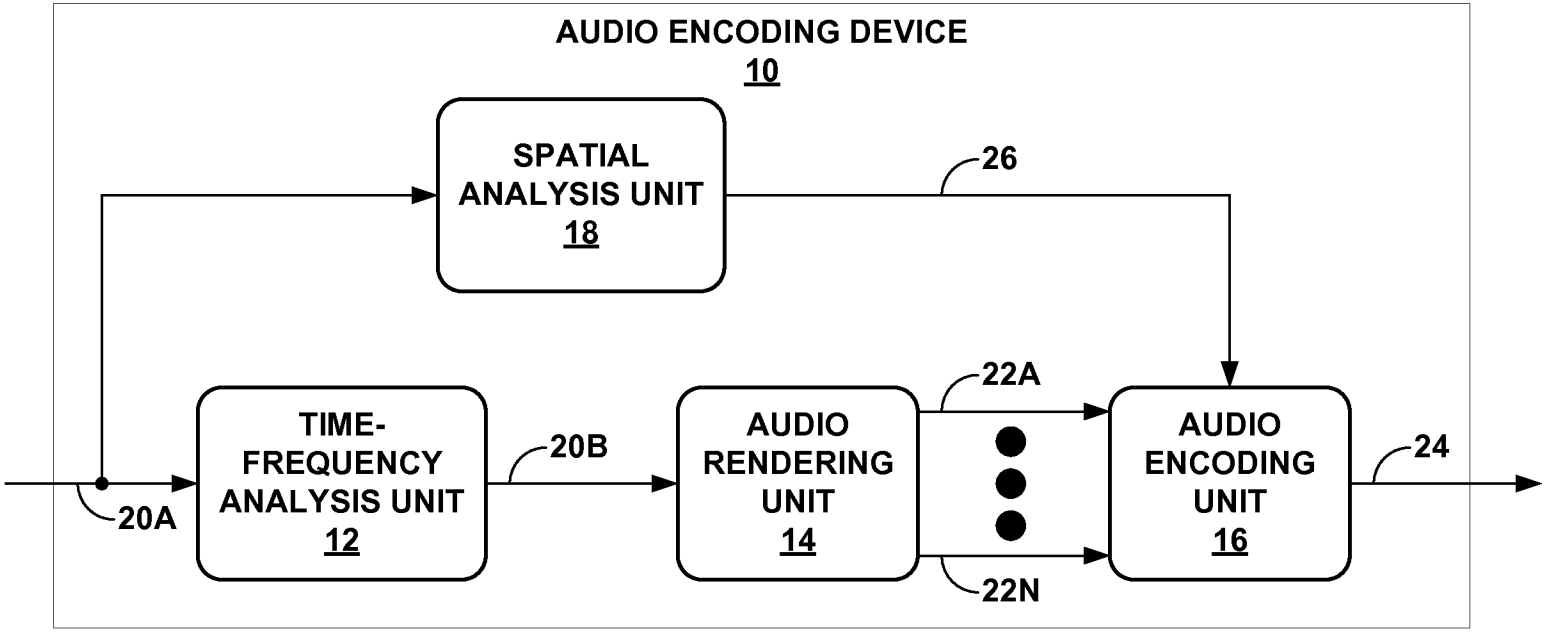
FIGS. 4A and 4B are each a block diagram illustrating an example audio encoding device that may perform various aspects of the techniques described in this disclosure to code spherical harmonic coefficients describing two or three dimensional sound fields.
Figure 4B:
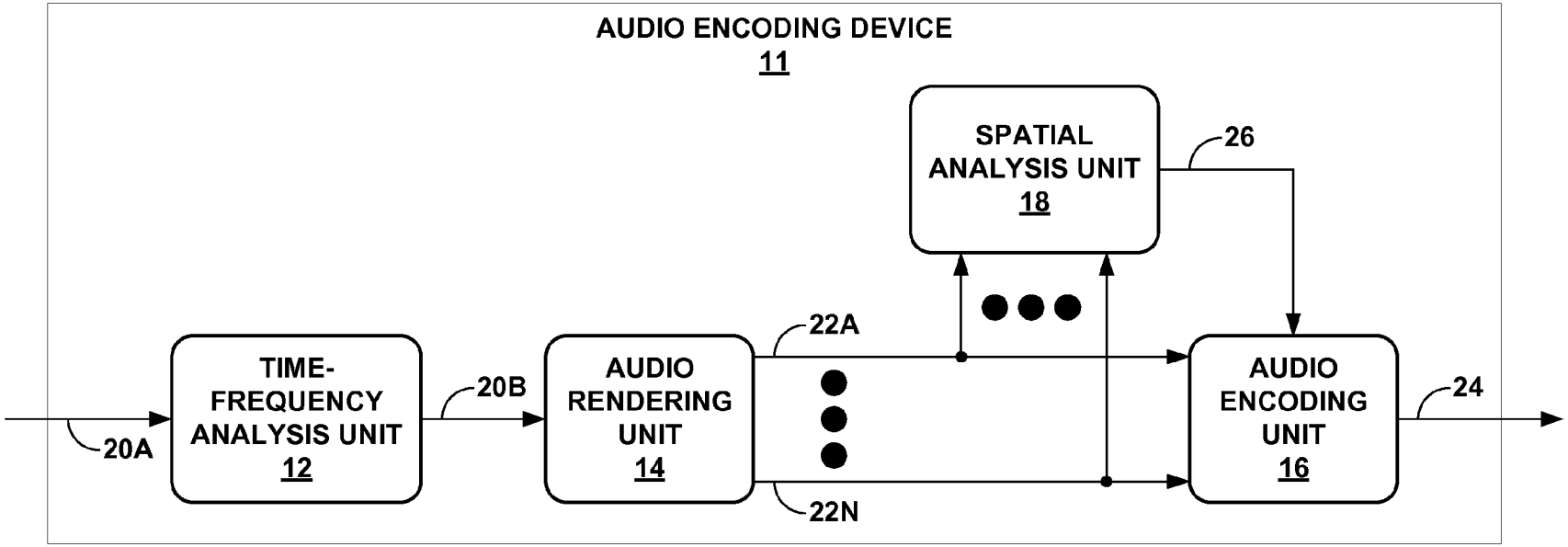

FIGS. 4A and 4B are each a block diagram illustrating an example audio encoding device 10 that may perform various aspects of the techniques described in this disclosure to code spherical harmonic coefficients describing two or three dimensional sound fields. In the example of FIG. 4A, the audio encoding device 10 generally represents any device capable of encoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of encoding audio data.

While shown as a single device, i.e., the device 10 in the example of FIG. 4A, the various components or units referenced below as being included within the device 10 may actually form separate devices that are external from the device 10. In other words, while described in this disclosure as being performed by a single device, i.e., the device 10 in the example of FIG. 4A, the techniques may be implemented or otherwise performed by a system comprising multiple devices, where each of these devices may each include one or more of the various components or units described in more detail below. Accordingly, the techniques should not be limited to the example of FIG. 4A.

As shown in the example of FIG. 4A, the audio encoding device 10 comprises a time-frequency analysis unit 12, an audio rendering unit 14, an audio encoding unit 16 and a spatial analysis unit 18. The time-frequency analysis unit 12 may represent a unit configured to perform a time-frequency analysis of spherical harmonic coefficients (SHC) 20A in order to transform the SHC 20A from the time domain to the frequency domain. The time-frequency analysis unit 12 may output the SHC 20B, which may denote the SHC 20A as expressed in the frequency domain. Although described with respect to the time-frequency analysis unit 12, the techniques may be performed with respect to the SHC 20A left in the time domain rather than performed with respect to the SHC 20B as transformed to the frequency domain.

The SHC 20A may refer to coefficients associated with one or more spherical harmonics. These spherical harmonics may be analogous to the trigonometric basis functions of a Fourier series. That is, spherical harmonics may represent the fundamental modes of vibration of a sphere around a microphone similar to how the trigonometric functions of the Fourier series may represent the fundamental modes of vibration of a string. These coefficients may be derived by solving a wave equation in spherical coordinates that involves the use of these spherical harmonics. In this sense, the SHC 20A may represent a 3D sound field surrounding a microphone as a series of spherical harmonics with the coefficients denoting the volume multiplier of the corresponding spherical harmonic.

Lower-order ambisonics (which may also be referred to as first-order ambisonics) may encode sound information into four channels denoted W, X, Y and Z. This encoding format is often referred to as a "B-format." The W channel refers to a non-directional mono component of the captured sound signal corresponding to an output of an omnidirectional microphone. The X, Y and Z channels are the directional components in three dimensions. The X, Y and Z channels typically correspond to the outputs of three figure-of-eight microphones, one of which faces forward, another of which faces to the left and the third of which faces upward, respectively. These B-format signals are commonly based on a spherical harmonic decomposition of the soundfield and correspond to the pressure (W) and the three component pressure gradients (X, Y and Z) at a point in space. Together, these four B-format signals (i.e., W, X, Y and Z) approximate the sound field around the microphone. Formally, these B-format signals may express the first-order truncation of the multipole expansion.

Higher-order ambisonics refers to a form of representing a sound field that uses more channels, representing finer modal components, than the original first-order B-format. As a result, higher-order ambisonics may capture significantly more spatial information. The "higher order" in the term "higher order ambisonics" refers to further terms of the multimodal expansion of the function on the sphere in terms of spherical harmonics. Increasing the spatial information by way of higher-order ambisonics may result in a better expression of the captured sound as pressure over a sphere. Using higher order ambisonics to produce the SHC 20A may enable better reproduction of the captured sound by speakers present at the audio decoder.

The audio rendering unit 14 represents a unit configured to render the SHC 20B to one or more channels 22A-22N ("channels 22," which may also be referred to as "speaker feeds 22A-22N"). Alternatively, when not transforming the SHC 20A to the SHC 20B, the audio rendering unit 14 may represent a unit configured to render the one or more channels 22A-22N from the SHC 20A. In some instances, the audio rendering unit 14 may render the SHC 20B to 32 channels (shown as channels 22 in the example of FIG. 4) corresponding to 32 speakers arranged in a dense T-design geometry. The audio rendering unit 14 may render the SHC 20B to 32 channels corresponding to 32 speakers arranged in a dense T-design to facilitate recovery of the SHC 20B at the decoder. That is, the math involved to render the SHC 20B to these 32 channels corresponding to 32 speakers arranged in this dense T-design includes a matrix that is invertible such that this matrix (which may be denoted by the variable R), multiplied by the inverted matrix (which may be denoted as $R^{-1}$) equals the identity matrix (denoted as I, with the entire mathematical expression being $RR^{-1}=I$). The above mathematical expression implies that there is no loss (or, in other words, little to no error is introduced) when recovering the SHC 32B at the audio decoder.

The audio encoding unit 16 may represent a unit configured to perform some form of audio encoding to compress the channels 22 into a bitstream 24. In some examples, the audio encoding unit 16 may include modified versions of audio encoders that conform to known spatial audio encoding standards, such as a Moving Picture Experts Group (MPEG) Surround defined in International Organization for Standardization (ISO)/International Electrotechnical Commission (IEC) 23003-1 or MPEG-D Part 1 (which may also be referred to as "Spatial Audio Coding" or "SAC") or MPEG Advanced Audio Coding (AAC) defined in both Part 7 of the MPEG-2 standard (which is also known as ISO/IEC 13818-7:1997) and Subpart 4 in Part 3 of the MPEG-4 standard (which is also known as ISO/IEC 14496-3:1999).

The spatial analysis unit 18 may represent a unit configured to perform spatial analysis of the SHC 20A. The spatial analysis unit 18 may perform this spatial analysis to identify areas of relative high and low pressure density (often expressed as a function of one or more of azimuth, angle, elevation angle and radius (or equivalent Cartesian coordinates)) in the sound field, analyzing the SHC 20A to identify spatial properties 26. These spatial properties 26 may specify one or more of an azimuth, angle, elevation angle and radius of various portions of the SHC 20A that have certain characteristics. The spatial analysis unit 18 may identify the spatial properties 26 to facilitate audio encoding by the audio encoding unit 16. That is, the spatial analysis unit 18 may provide the spatial properties 26 to the audio encoding unit 16, which may be modified to take advantage of psychoacoustic spatial or positional masking and other spatial characteristics of the sound field represented by the SHC 20A.

Spatial masking may leverage tendencies of the human auditory system to mask neighboring spatial portions (or 3D segments) of the sound field when a high energy acoustic energy are present in the sound field. That is, high energy portions of the sound field may overwhelm the human auditory system such that portions of energy (often, adjacent areas of low energy) are unable to be detected (or discerned) by the human auditory system. As a result, the audio encoding unit 18 may allow lower number of bits (or equivalently higher quantization noise) to represent the sound field in these so-called "masked" segments of space, where the human auditory systems may be unable to detect (or discern) sounds when high energy portions are detected in neighboring areas of the sound field defined by the SHC 20A. This is similar to representing the sound field in those "masked" spatial regions with lower precision (meaning possibly higher noise).

In operation, the audio encoding device 10 may implement various aspects of the techniques described in this disclosure by first invoking the spatial analysis unit 18 to performing spatial analysis with respect to the SHC 20A that describe a three-dimensional sound field to identify the spatial properties 26 of the sound field. The audio encoding device 10 may then invoke the audio rendering unit 14 to render the channels 22 (which may also be referred to as the "multi-channel audio data 22") from either the SHC 20A (when, as noted above, the time-frequency analysis is not performed) or the SHC 20B (when the time-frequency analysis is performed). After or concurrent to the rendering this multi-channel audio data 22, the audio encoding device 10 may invoke the audio encoding unit 16 to encode the multi-channel audio data 22 based on the identified spatial properties 26 to generate the bitstream 24. As noted above, the audio encoding unit 16 may perform a standards-compliant form of audio encoding that has been modified in various ways to leverage the spatial properties 26 (e.g., to perform the above described spatial masking).

In this way, the techniques may effectively encode the SHC 20A such that, as described in more detail below, an audio decoding device, such as the audio decoding device 30 shown in the example of FIG. 5, may recover the SHC 20A. By selecting to render the SHC 20A or the SHC 20B (depending on whether the time-frequency analysis is performed) to 32 speakers arranged in a dense T-design, the mathematical expression is invertible, which means that there is little to no loss of accuracy due to the rendering. By selecting a dense speaker geometry that includes more speakers than commonly present at the decoder, the techniques provide for good re-synthesis of the sound field. In other words, by rendering multi-channel audio data assuming a dense speaker geometry, the multi-channel audio data includes a sufficient amount of data describing the sound field, such that upon reconstructing the SHC 20A at the audio decoding device 30, the audio decoding device 30 may re-synthesize the sound field having sufficient fidelity using the decoder-local speakers configured in less-than-optimal speaker geometries. The phrase "optimal speaker geometries" may refer to those specified by standards, such as those defined by various popular surround sound standards, and/or to speaker geometries that adhere to certain geometries, such as a dense T-design geometry or a platonic solid geometry.

In some instances, this spatial masking may be performed in conjunction with other types of masking, such as simultaneous masking. Simultaneous masking, much like spatial masking, involves the phenomena of the human auditory system, where sounds produced concurrent (and often at least partially simultaneously) to other sounds mask the other sounds. Typically, the masking sound is produced at a higher volume than the other sounds. The masking sound may also be similar to close in frequency to the masked sound. Thus, while described in this disclosure as being performed alone, the spatial masking techniques may be performed in conjunction with or concurrent to other forms of masking, such as the above noted simultaneous masking.

FIG. 4B is a block diagram illustrating a variation of audio encoding device 10 shown in the example of FIG. 4A. In the example of FIG. 4B, the variation of audio encoding device 10 is denoted as "audio encoding device 11." The audio encoding device 11 may be similar to the audio encoding device 10 in that the audio encoding device 11 also includes a time-frequency analysis unit 12, an audio rendering unit 14, an audio encoding unit 16 and a spatial analysis unit 18. However, rather than operate on SHC 20A, the spatial analysis unit 18 of the audio encoding device 11 may process the channels 22 to identify the spatial parameters 26 (which may include the spatial masking thresholds). In this respect, the spatial analysis unit 18 of the audio encoding device 11 may perform the spatial analysis in the channel domain rather than the spatial domain.

In this manner, the techniques may enable the audio encoding device 11 to render a plurality of spherical harmonic coefficients 20B that describe a sound field of the audio in three dimensions to generate multi-channel audio data (which is shown as channels 22 in the example of FIG. 4B). The audio encoding device 11 may then perform spatial analysis with respect to the multi-channel audio data to identify a spatial masking threshold and compress the multi-channel audio data based on the identified spatial masking threshold to generate a bitstream.

In some instances, when compressing the audio data, the audio encoding device 11 may allocate bits in the bitstream for either a time-based representation of the multi-channel audio data or a frequency-based representation of the multi-channel audio data based on the spatial masking threshold.

In some instances, when compressing the audio data, the audio encoding device 11 may allocate bits in the bitstream for either a time-based representation of the multi-channel audio data or a frequency-based representation of the multi-channel audio data based on the spatial masking threshold and a temporal masking threshold.

In some instances, when compressing the audio data, the audio encoding device 11 may perform a parametric inter-channel audio encoding (such as an MPEG Surround audio encoding) with respect to the multi-channel audio data to generate the bitstream.

In some instances, when compressing the audio data, the audio encoding device 11 may allocating bits for representing the multi-channel audio data based on the spatial masking threshold to generate the bitstream.

In some instances, the audio encoding device 11 may transform the multi-channel audio data from the spatial domain to the time domain. When compressing the audio data, the audio encoding device 11 may then allocate bits for representing various frequency bins of the transformed multi-channel audio data based on the spatial masking threshold to generate the bitstream.

Figure 5:
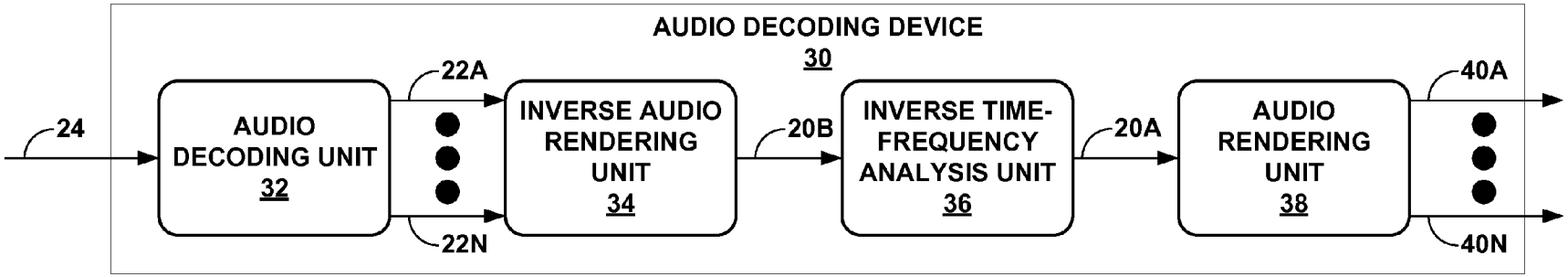
FIG. 5 is a block diagram illustrating an example audio decoding device that may perform various aspects of the techniques described in this disclosure to decode spherical harmonic coefficients describing two or three dimensional sound fields.

FIG. 5 is a block diagram illustrating an example audio decoding device 10 that may perform various aspects of the techniques described in this disclosure to decode spherical harmonic coefficients describing three dimensional sound fields. The audio decoding device 30 generally represents any device capable of decoding audio data, such as a desktop computer, a laptop computer, a workstation, a tablet or slate computer, a dedicated audio recording device, a cellular phone (including so-called "smart phones"), a personal media player device, a personal gaming device, or any other type of device capable of decoding audio data.

Generally, the audio decoding device 30 performs an audio decoding process that is reciprocal to the audio encoding process performed by the audio encoding device 10 with the exception of performing spatial analysis, which is typically used by the audio encoding device 10 to facilitate the removal of extraneous irrelevant data (e.g., data that would be masked or incapable of being perceived by the human auditory system). In other words, the audio encoding device 10 may lower the precision of the audio data representation as the typical human auditory system may be unable to discern the lack of precision in these areas (e.g., the "masked" areas, both in time and, as noted above, in space). Given that this audio data is irrelevant, the audio decoding device 30 need not perform spatial analysis to reinsert such extraneous audio data.

While shown as a single device, i.e., the device 30 in the example of FIG. 5, the various components or units referenced below as being included within the device 30 may form separate devices that are external from the device 30. In other words, while described in this disclosure as being performed by a single device, i.e., the device 30 in the example of FIG. 5, the techniques may be implemented or otherwise performed by a system comprising multiple devices, where each of these devices may each include one or more of the various components or units described in more detail below. Accordingly, the techniques should not be limited to the example of FIG. 5.

As shown in the example of FIG. 5, the audio decoding device 30 comprises an audio decoding unit 32, an inverse audio rendering unit 34, an inverse time-frequency analysis unit 36, and an audio rendering unit 38. Audio decoding unit 16 may represent a unit configured to perform some form of audio decoding to decompress the bitstream 24 to recover the channels 22. In some examples, the audio decoding unit 32 may include modified versions of audio decoders that conform to known spatial audio encoding standards, such as a MPEG SAC or MPEG ACC.

The inverse audio rendering unit 34 may represent a unit configured to perform an rendering process inverse to the rendering process performed by the audio rendering unit 14 of the audio encoding device 10 to recover the SHC 20B. The inverse audio rendering unit 34 may apply the inverse transform matrix, $R^{-1}$, described above. Alternatively, when the SHC 20A was not transformed to generate the SHC 20B, the inverse audio rendering unit 34 may represent a unit configured to render the SHC 20A from the channels 22 through application of the inverse matrix $R^{-1}$. In some instances, the inverse audio rendering unit 34 may render the SHC 20B from 32 channels corresponding to 32 speakers arranged in a dense T-design for the reasons described above.

The inverse time-frequency analysis unit 36 may represent a unit configured to perform an inverse time-frequency analysis of the spherical harmonic coefficients (SHC) 20B in order to transform the SHC 20B from the frequency domain to the time domain. The inverse time-frequency analysis unit 36 may output the SHC 20A, which may denote the SHC 20B as expressed in the time domain. Although described with respect to the inverse time-frequency analysis unit 36, the techniques may be performed with respect to the SHC 20A in the time domain rather than performed with respect to the SHC 20B in the frequency domain.

The audio rendering unit 38 represents a unit configured to render the channels 40A-40N (the "channels 40," which may also be generally referred to as the "multi-channel audio data 40" or as the "loudspeaker feeds 40"). The audio rendering unit 38 may apply a transform (often expressed in the form of a matrix) to the SHC 20A. Because the SHC 20A describe the sound field in three dimensions, the SHC 20A represent an audio format that facilitates rendering of the multichannel audio data 40 in a manner that is capable of accommodating most decoder-local speaker geometries (which may refer to the geometry of the speakers that will playback multi-channel audio data 40). Moreover, by rendering the SHC 20A to channels for 32 speakers arranged in a dense T-design at the audio encoding device 10, the techniques provide sufficient audio information (in the form of the SHC 20A) at the decoder to enable the audio rendering unit 38 to reproduce the captured audio data with sufficient fidelity and accuracy using the decoder-local speaker geometry. More information regarding the rendering of the multi-channel audio data 40 is described below with respect to FIG. 8.

In operation, the audio decoding device 30 may invoke the audio decoding unit 32 to decode the bitstream 24 to generate the first multi-channel audio data 22 having a plurality of channels corresponding to speakers arranged in a first speaker geometry. This first speaker geometry may comprise the above noted dense T-design, where the number of speakers may be, as one example, 32. While described in this disclosure as including 32 speakers, the dense T-design speaker geometry may include 64 or 128 speakers to provide a few alternative examples. The audio decoding device 30 may then invoke the inverse audio rendering unit 34 to perform an inverse rendering process with respect to generated the first multi-channel audio data 22 to generate the SHC 20B (when the time-frequency transforms is performed) or the SHC 20A (when the time-frequency analysis is not performed). The audio decoding device 30 may also invoke the inverse time-frequency analysis unit 36 to transform, when the time frequency analysis was performed by the audio encoding device 10, the SHC 20B from the frequency domain back to the time domain, generating the SHC 20A. In any event, the audio decoding device 30 may then invoke the audio rendering unit 38, based on the encoded-decoded SHC 20A, to render the second multi-channel audio data 40 having a plurality of channels corresponding to speakers arranged in a local speaker geometry.

Figure 6A:
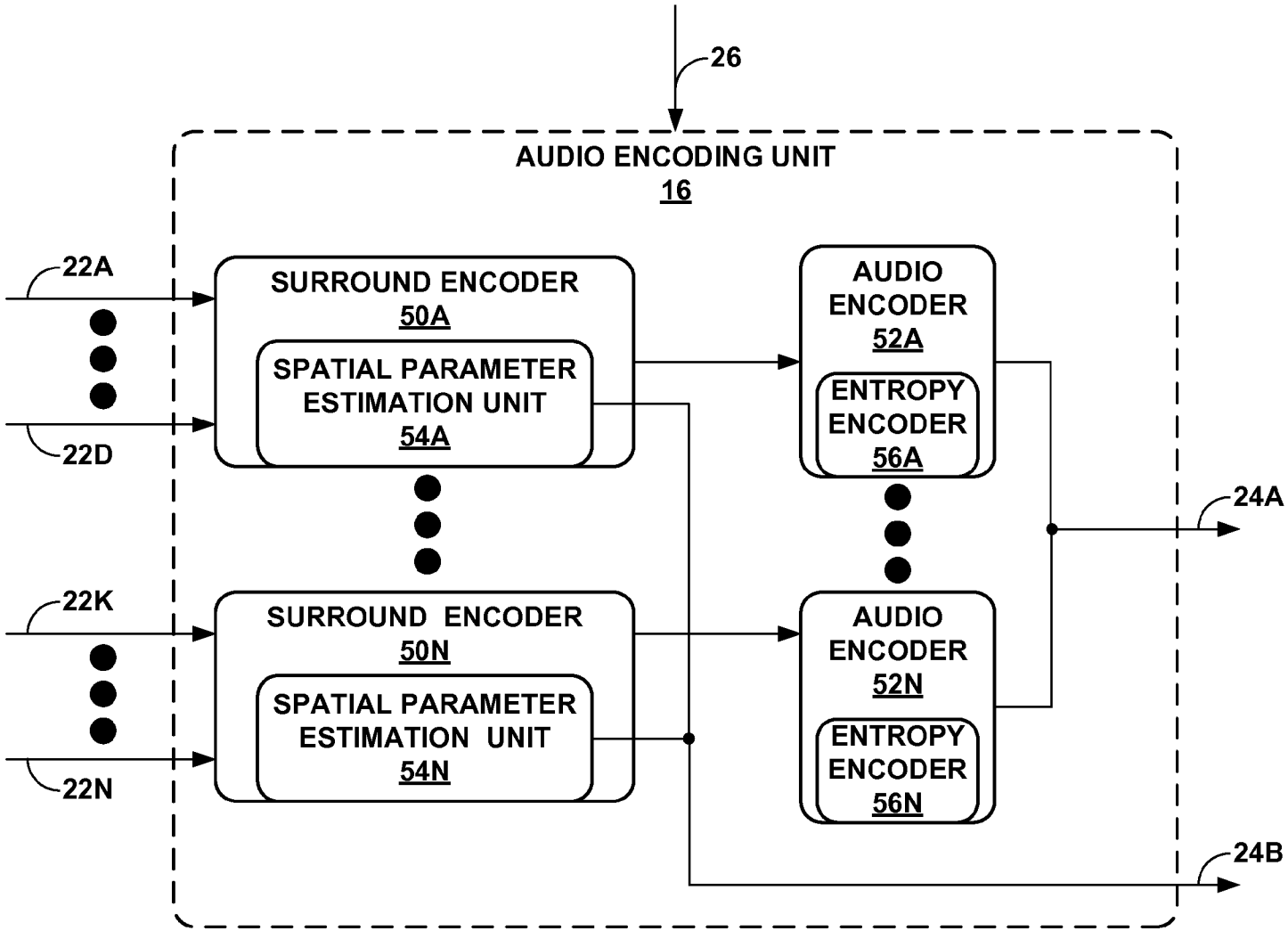
FIGS. 6A-6C are block diagrams illustrating in more detail example variations of the audio encoding unit shown in the example of FIG. 4A.
Figure 6B:
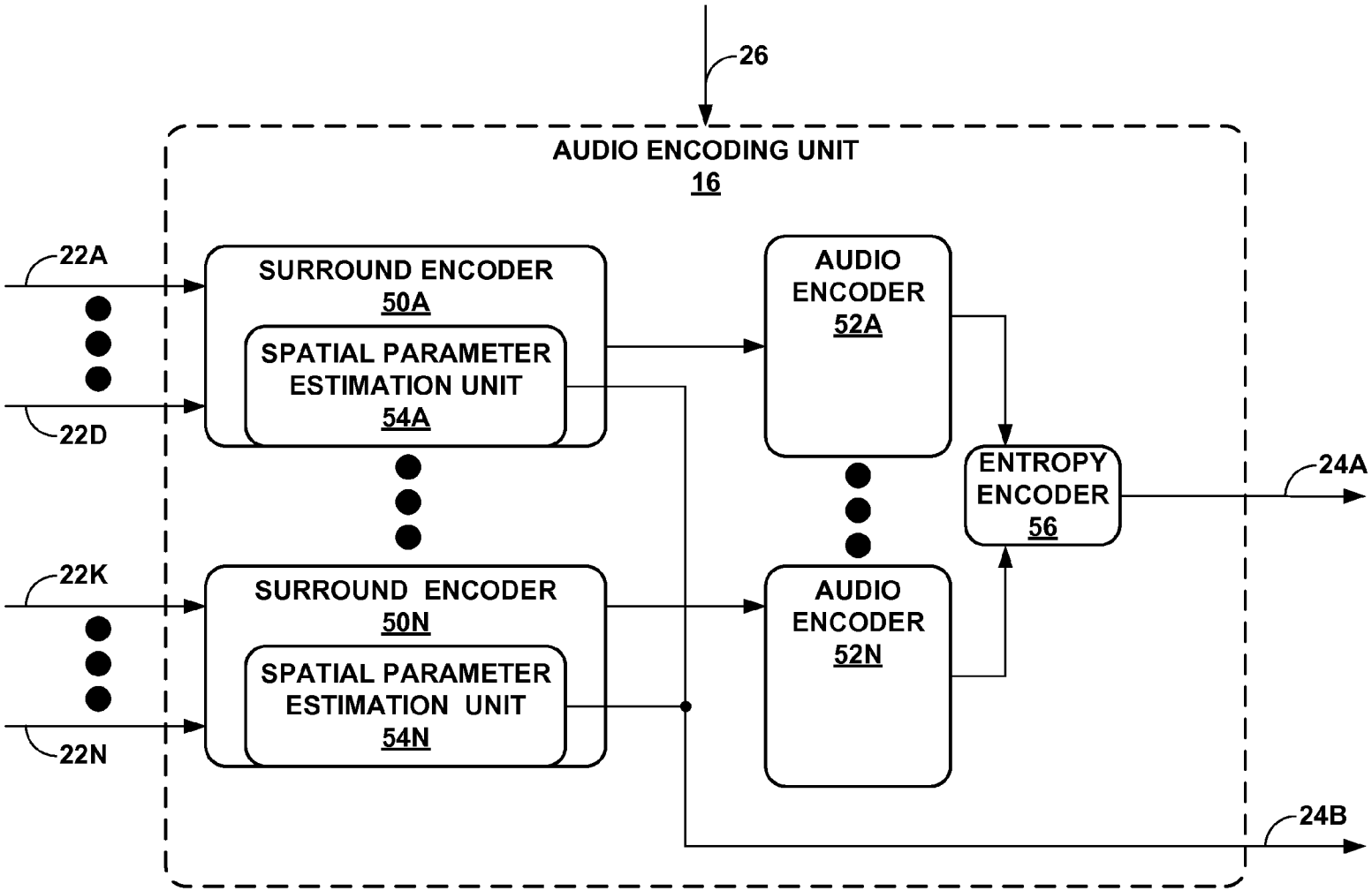
Figure 6C:
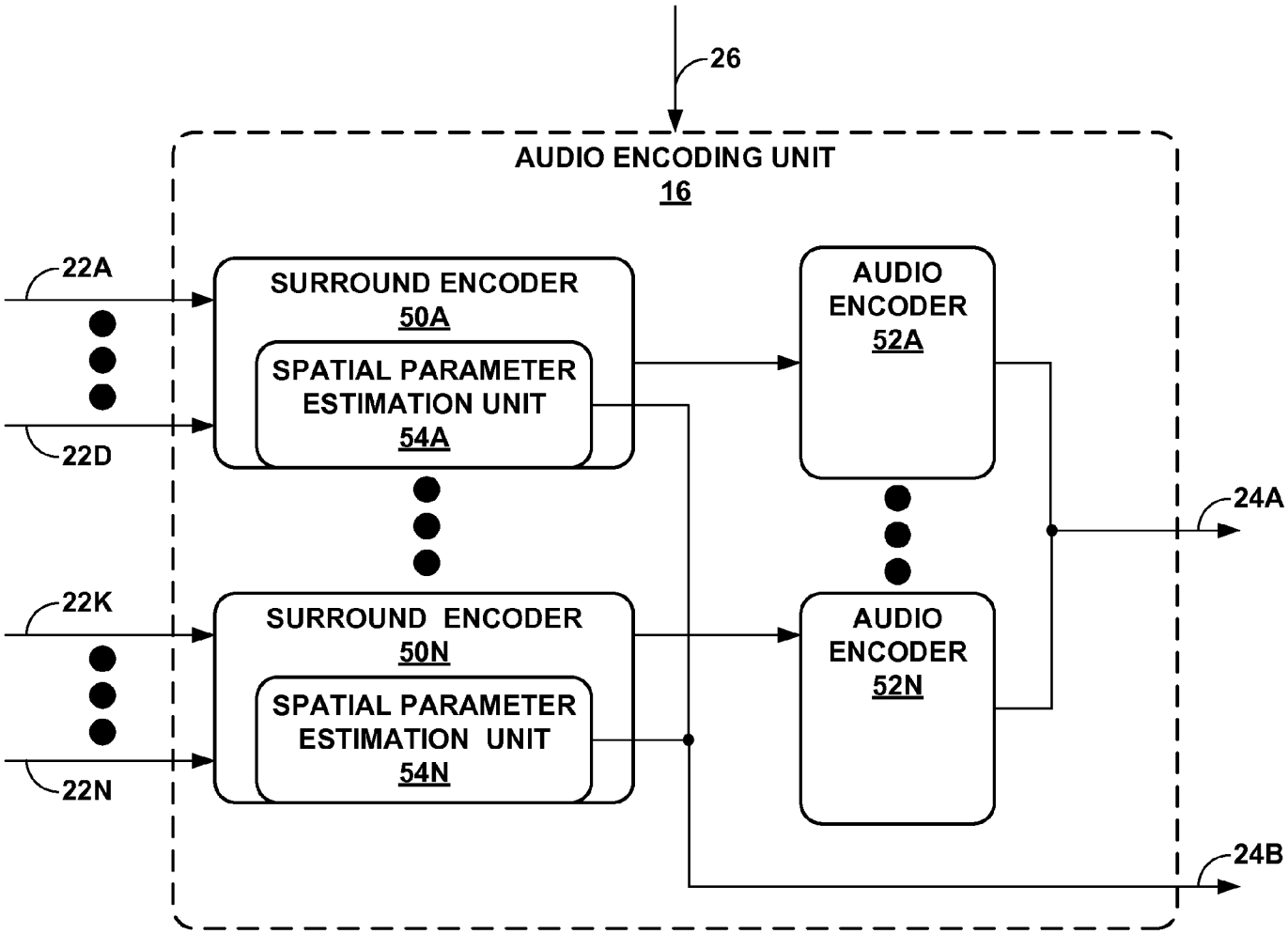

FIGS. 6A-6C are each block diagrams illustrating in more detail different example variations of the audio encoding unit 16 shown in the example of FIG. 4A. In the example of FIG. 4A, the audio encoding unit 16 includes surround encoders 50A-50N ("surround encoders 50") and audio encoders 52A-52N ("audio encoders 52"). Each of the surround encoders 50 may represent a unit configured to perform a form of audio surround encoding to encode the multi-channel audio data so as to generate a surround sound encoded version of the multi-channel audio data (which may be referred to as a surround sound audio encoded multi-channel audio data. Each of the audio encoders 52 may represent a unit configured to audio encode the surround sound audio encoded multi-channel audio data to generate the bitstream 24A (which may refer to a portion of the bitstream 24 shown in the example of FIG. 4A).

Each of the surround encoders 50 may perform a modified version of the above referenced MPEG Surround to encode the multi-channel audio data. This modified version may represent a version of MPEG Surround that encodes the multi-channel audio data 22 based on the spatial properties 26 determined by the spatial analysis module 18 (shown in the example of FIG. 1). Each of the surround encoders 50 may include a corresponding one of spatial parameter estimation units 54A-54N ("spatial parameter estimation units 54"). A corresponding one of the audio encoders 52 may encode one of a corresponding subset of the channels 22 in detail. However, prior to encoding this one of the corresponding subset of the channels 22 in detail, each of the respective spatial parameter estimation units 54 may encode the remaining ones of the corresponding subsets of the channels 22 relative to the one of the corresponding subset of the channels 22. That is, each of the spatial parameter estimation units 54 may determine or, in some instances, estimate spatial parameters reflecting the difference between the one of the corresponding subsets of the channels 22 and the remaining ones of the corresponding subsets of the channels 22. These spatial parameters may include, to provide a few examples, inter-channel level, inter-channel time and inter-channel correlation. The spatial parameter estimation units 54 may each output these spatial parameters as bitstream 24B (which again may denote a portion of the bitstream 24 shown in the example of FIG. 4A).

In some instances, the spatial parameter estimation units 54 may each be modified to determine these spatial parameters based at least in part on the spatial properties 26 determined by the spatial analysis unit 18. To illustrate, each of the spatial parameter estimation units 54 may calculate the delta or difference between the channels and thereby determining the spatial parameters (which may include inter-channel level, inter-channel time and inter-channel correlation) based on the spatial properties 26. For example, based on the spatial properties 26, the spatial parameter estimation units 54 may determine an accuracy with which to specify the spatial parameters (or, in other words, how coarsely to quantize the parameters when not a lot of energy is present).

In any event, each of the surround encoders 50 output the one of the corresponding subset of the channels 22 to a corresponding one of the audio encoders 52, which encodes this one of the corresponding subset of the channels 22 as a mono-audio signal. That is, each of the audio encoders 52 represents a mono aural audio encoder 52. The audio encoders 52 may include a corresponding one of the entropy encoders 56A-56N ("entropy encoders 56"). Each of the entropy encoders 56 may perform a form of lossless statistical coding (which is commonly referred to by the misnomer "entropy coding"), such as Huffman coding, to encode the one of the corresponding subset of the channels 22. In some instances, the entropy encoders 56 may each perform this entropy coding based on the spatial properties 26. Each of the entropy encoders 56 may output an encoded version of multi-channel audio data, which may be multiplexed with other encoded versions of multi-channel audio data and the spatial parameters 24B to form the bitstream 24.

In the example of FIG. 6B, rather than each of the audio encoders 52 including a separate entropy encoder 56, the audio encoding unit 16 includes a single entropy encoder 56 that entropy encodes (which may also be referred to as "statistical lossless codes") each of the outputs of the audio encoders 52. In most all other ways, the audio encoding unit 16 shown in the example of FIG. 6B may be similar to the audio encoding unit 16 shown in the example of FIG. 6C. Although not shown in the example of FIG. 6B, the audio encoding unit 16 may include a mixer or mixing unit to merge or otherwise combine the output of each of the audio encoders 52 to form a single bitstream to which the entropy encoder 56 may perform statistical lossless coding to compress this bitstream and form the bitstream 24A.

In the example of FIG. 6C, the audio encoding unit 16 includes the audio encoders 52A-52N that do not include the entropy encoders 56. The audio encoding unit 16 shown in the example of FIG. 6C does not include any form of entropy encoding for encoding audio data. Instead, this audio encoding unit 16 may perform the spatial masking techniques described in this disclosure. In some instances, the audio encoding device 16 of FIG. 6C only performs masking (either temporally or spatially or both temporally and spatially, as described in more detail below) without performing any form of entropy encoding.

Figure 7:
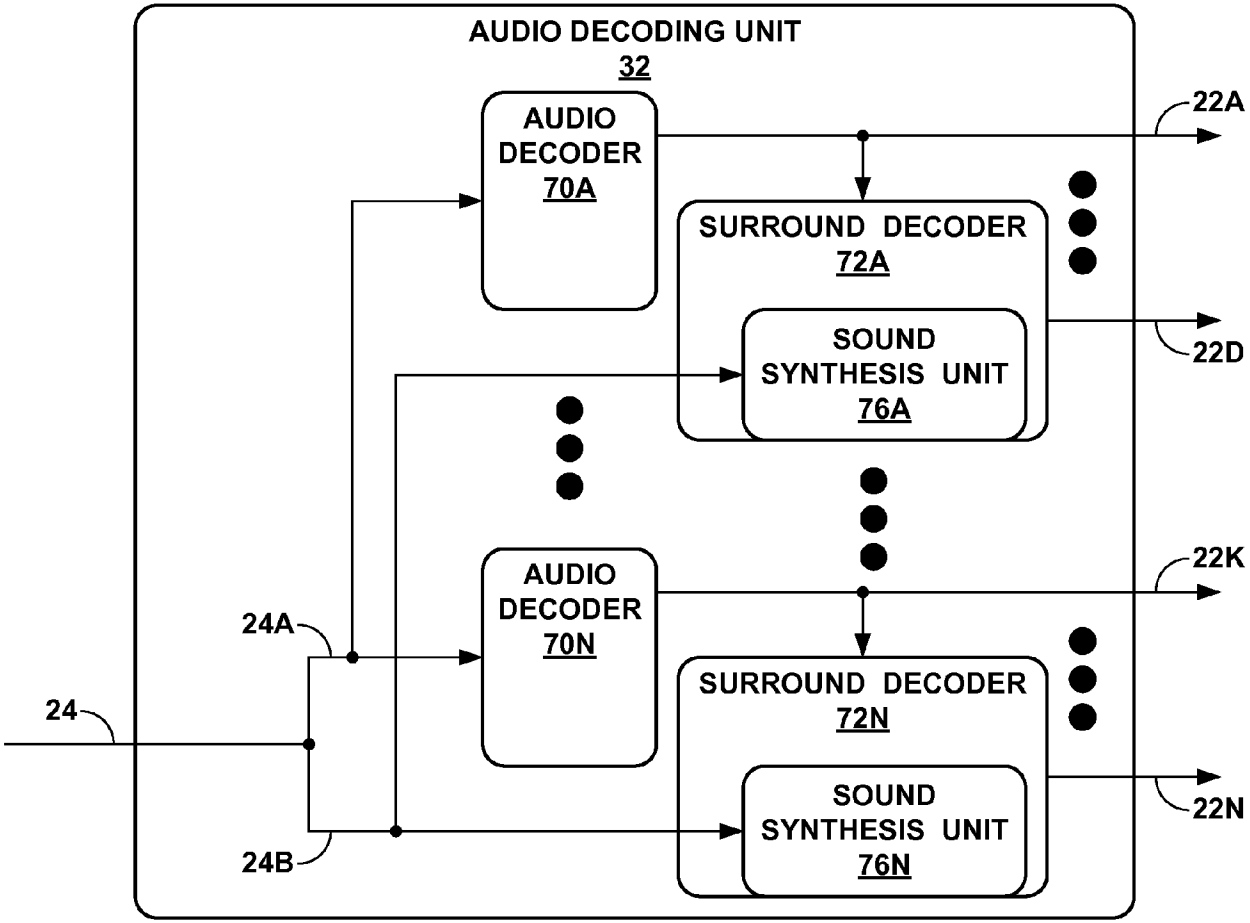
FIG. 7 is a block diagram illustrating in more detail an example of the audio decoding unit of FIG. 2.

FIG. 7 is a block diagram illustrating in more detail an example of the audio decoding unit 32 of FIG. 5. Referring first to the example of FIG. 7, the first variation of the audio decoding unit 32 includes the audio decoders 70A-70N ("audio decoders 70") and the surround decoders 72A-72N ("surround decoders 72"). Each of the audio decoders 70 may perform a mono aural audio decoding process reciprocal to that performed by the audio encoders 50 described above with respect to the example of FIG. 6A. Although not shown in the example of FIG. 7 for ease of illustration purposes, each of the audio decoders 70 may include an entropy decoder or not similar to the variations described above with respect to FIGS. 6A-6C of the entropy encoding unit 16. Each of the audio decoders 70 may receive a respective portion of the bitstream 24, denoted as the portions 24A in the example of FIG. 7, and decode the respective one of the portions 24A to output one of a corresponding subset of the channels 22. The portion 24A of bitstream 24 and the portion 24B of the bitstream 24 may be de-multiplexed using a demultiplexer, which is not shown in the example of FIG. 7 for ease of illustration purposes.

The surround decoder 72A may represent a unit configured to resynthesize the remaining ones of the corresponding subset of the channels 22 based on spatial parameters denoted as the bitstream portions 24B. The surround decoders 72 may each include a corresponding one of sound synthesis units 76A-76N ("sound synthesis units 76") that receives the decoded one of the corresponding subsets of the channels 22 and these spatial parameters. Based on the spatial parameters, each of the sound synthesis units 76 may resynthesize the remaining ones of the corresponding subsets of the channels 22. In this manner, the audio decoding unit 32 may decode the bitstream 24 to generate the multi-channel audio data 22.

Figure 8:
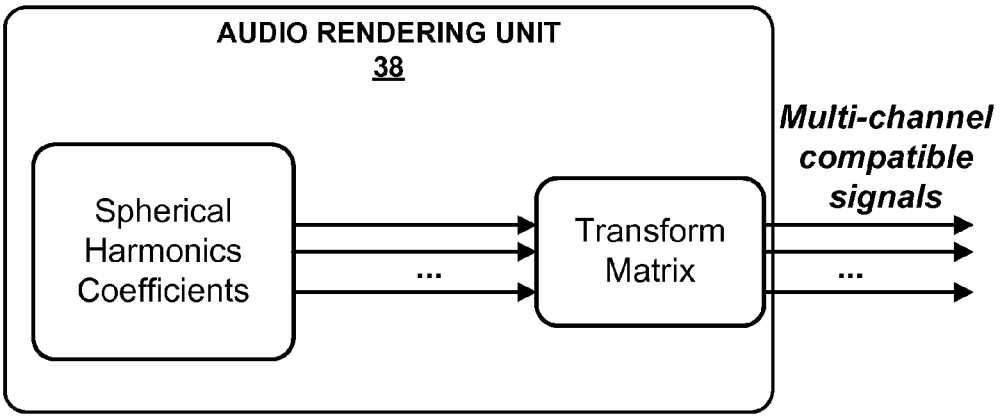
FIG. 8 is a block diagram illustrating the audio rendering unit shown in the example of FIG. 5 in more detail.

FIG. 8 is a block diagram illustrating the audio rendering unit 38 of the audio decoding unit 32 shown in the example of FIG. 5 in more detail. Generally, FIG. 8 illustrates a conversion from the SHC 20A to the multi-channel audio data 40 that is compatible with a decoder-local speaker geometry. For some local speaker geometries (which, again, may refer to a speaker geometry at the decoder), some transforms that ensure invertibility may result in less-than-desirable audio-image quality. That is, the sound reproduction may not always result in a correct localization of sounds when compared to the audio being captured. In order to correct for this less-than-desirable image quality, the techniques may be further augmented to introduce a concept that may be referred to as "virtual speakers." Rather than require that one or more loudspeakers be repositioned or positioned in particular or defined regions of space having certain angular tolerances specified by a standard, such as the above noted ITU-R BS.775-1, the above framework may be modified to include some form of panning, such as vector base amplitude panning (VBAP), distance based amplitude panning, or other forms of panning Focusing on VBAP for purposes of illustration, VBAP may effectively introduce what may be characterized as "virtual speakers." VBAP may generally modify a feed to one or more loudspeakers so that these one or more loudspeakers effectively output sound that appears to originate from a virtual speaker at one or more of a location and angle different than at least one of the location and/or angle of the one or more loudspeakers that supports the virtual speaker.

To illustrate, the above equation for determining the loudspeaker feeds in terms of the SHC may be modified as follows:

$$\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix} = -ik \begin{bmatrix} VBAP \\ \text{MATRIX} \\ MxN \end{bmatrix} \begin{bmatrix} D \\ Nx(\text{Order}+1)^2 \end{bmatrix} \begin{bmatrix} g_1(\omega) \\ g_2(\omega) \\ g_3(\omega) \\ \dots \\ g_M(\omega) \end{bmatrix}.$$

In the above equation, the VBAP matrix is of size M rows by N columns, where M denotes the number of speakers (and would be equal to five in the equation above) and N denotes the number of virtual speakers. The VBAP matrix may be computed as a function of the vectors from the defined location of the listener to each of the positions of the speakers and the vectors from the defined location of the listener to each of the positions of the virtual speakers. The D matrix in the above equation may be of size N rows by $(\text{order}+1)^2$ columns, where the order may refer to the order of the SH functions. The D matrix may represent the following matrix:

$$\begin{bmatrix} h_0^{(2)}(kr_1)Y_0^{0*}(\theta_1, \varphi_1) & h_0^{(2)}(kr_2)Y_0^{0*}(\theta_2, \varphi_2) & \dots & \dots & \dots \\ h_1^{(2)}(kr_1)Y_1^{1*}(\theta_1, \varphi_1). & \dots & \dots & \dots & \dots \\ \dots & \dots & \dots & \dots & \dots \\ \dots & \dots & \dots & \dots & \dots \\ \dots & \dots & \dots & \dots & \dots \end{bmatrix}.$$

The g matrix (or vector, given that there is only a single column) may represent the gain for speaker feeds for the speakers arranged in the decoder-local geometry. In the equation, the g matrix is of size M. The A matrix (or vector, given that there is only a single column) may denote the SHC 20A, and is of size (Order+1)(Order+1), which may also be denoted as $(\text{Order}+1)^2$.

In effect, the VBAP matrix is an M×N matrix providing what may be referred to as a "gain adjustment" that factors in the location of the speakers and the position of the virtual speakers. Introducing panning in this manner may result in better reproduction of the multi-channel audio that results in a better quality image when reproduced by the local speaker geometry. Moreover, by incorporating VBAP into this equation, the techniques may overcome poor speaker geometries that do not align with those specified in various standards.

In practice, the equation may be inverted and employed to transform the SHC 20A back to the multi-channel feeds 40 for a particular geometry or configuration of loudspeakers, which again may be referred to as the decoder-local geometry in this disclosure. That is, the equation may be inverted to solve for the g matrix. The inverted equation may be as follows:

$$\begin{bmatrix} g_1(\omega) \\ g_2(\omega) \\ g_3(\omega) \\ \dots \\ g_M(\omega) \end{bmatrix} = -ik \begin{bmatrix} VBAP \\ \text{MATRIX}^{-1} \\ MxN \end{bmatrix} \begin{bmatrix} D^{-1} \\ Nx(\text{Order}+1)^2 \end{bmatrix} \begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix}.$$

The g matrix may represent speaker gain for, in this example, each of the five loudspeakers in a 5.1 speaker configuration. The virtual speakers locations used in this configuration may correspond to the locations defined in a 5.1 multichannel format specification or standard. The location of the loudspeakers that may support each of these virtual speakers may be determined using any number of known audio localization techniques, many of which involve playing a tone having a particular frequency to determine a location of each loudspeaker with respect to a headend unit (such as an audio/video receiver (A/V receiver), television, gaming system, digital video disc system, or other types of headend systems). Alternatively, a user of the headend unit may manually specify the location of each of the loudspeakers. In any event, given these known locations and possible angles, the headend unit may solve for the gains, assuming an ideal configuration of virtual loudspeakers by way of VBAP.

In this respect, the techniques may enable a device or apparatus to perform a vector base amplitude panning or other form of panning on the plurality of virtual channels to produce a plurality of channels that drive speakers in a decoder-local geometry to emit sounds that appear to originate form virtual speakers configured in a different local geometry. The techniques may therefore enable the audio decoding unit 32 to perform a transform on the plurality of spherical harmonic coefficients, such as the SHC 20A, to produce a plurality of channels. Each of the plurality of channels may be associated with a corresponding different region of space. Moreover, each of the plurality of channels may comprise a plurality of virtual channels, where the plurality of virtual channels may be associated with the corresponding different region of space. The techniques may, in some instances, enable a device to perform vector base amplitude panning on the virtual channels to produce the plurality of channel of the multi-channel audio data 40.

Figure 9:
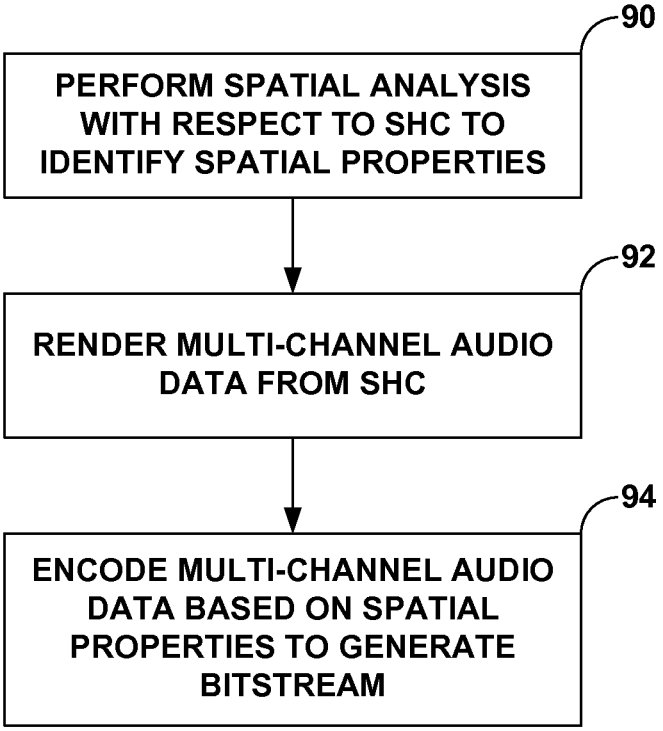
FIG. 9 is a flowchart illustrating exemplary operation of an audio encoding device in performing various aspects of the techniques described in this disclosure.

FIG. 9 is a flowchart illustrating exemplary operation of an audio encoding device, such as the audio encoding device 10 shown in the example of FIG. 4, in performing various aspects of the techniques described in this disclosure. In operation, the audio encoding device 10 may implement various aspects of the techniques described in this disclosure by first invoking the spatial analysis unit 18 to performing spatial analysis with respect to the SHC 20A that describe a three-dimensional sound field to identify the spatial properties 26 of the sound field (90). The audio encoding device 10 may then invoke the audio rendering unit 14 to render the multi-channel audio data 22 (which may also be referred to as the "multi-channel audio data 22") from either the SHC 20A (when, as noted above, the time-frequency analysis is not performed) or the SHC 20B (when the time-frequency analysis is performed) (92). After or concurrent to the rendering this multi-channel audio data 22, the audio encoding device 10 may invoke the audio encoding unit 16 to encode the multi-channel audio data 22 based on the identified spatial properties 26 to generate the bitstream 24 (94). As noted above, the audio encoding unit 16 may perform a standards-compliant form of audio encoding that has been modified in various ways to leverage the spatial properties 26 (e.g., to perform the above described spatial masking).

Figure 10:
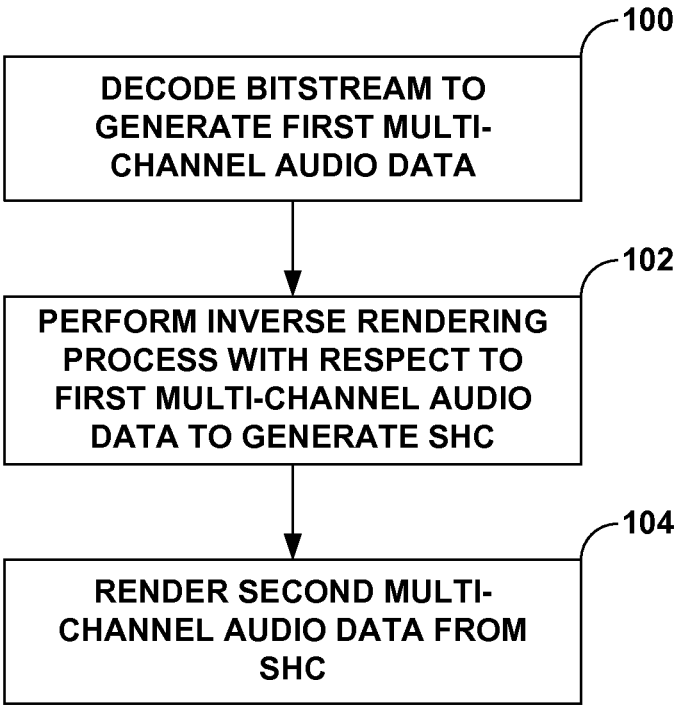
FIG. 10 is a flowchart illustrating exemplary operation of an audio decoding device in performing various aspects of the techniques described in this disclosure.

FIG. 10 is a flowchart illustrating exemplary operation of an audio decoding device, such as the audio decoding device 30 shown in the example of FIG. 5, in performing various aspects of the techniques described in this disclosure. In operation, the audio decoding device 30 may invoke the audio decoding unit 32 to decode the bitstream 24 to generate the first multi-channel audio data 22 having a plurality of channels corresponding to speakers arranged in a first speaker geometry (100). This first speaker geometry may comprise the above noted dense T-design, where the number of speakers may be, as one example, 32. Generally, the number of speakers in the first speaker geometry should exceed the number of speakers in the decoder-local speaker geometry to provide for high-fidelity during playback of the audio data by the decoder local speaker geometry.

The audio decoding device 30 may then invoke the inverse audio rendering unit 34 to perform an inverse rendering process with respect to generated the first multi-channel audio data 22 to generate the SHC 20B (when the time-frequency transforms is performed) or the SHC 20A (when the time-frequency analysis is not performed) (102). The audio decoding device 30 may also invoke the inverse time-frequency analysis unit 36 to transform, when the time frequency analysis was performed by the audio encoding device 10, the SHC 20B from the frequency domain back to the time domain, generating the SHC 20A. In any event, the audio decoding device 10 may then invoke the audio rendering unit 38 to render the second multi-channel audio data 40 having a plurality of channels corresponding to speakers arranged in a local speaker geometry based on the SHC 20A (104).

In this way, the techniques may use existing audio coders (and modify various aspects of it to accommodate spatial information from the SHC). To do that, the techniques may take the SH coefficients and render them (using renderer R1) to an arbitrary—but dense set of loudspeakers. The geometry of these loudspeakers may be such that an inverse renderer (R1_inv) can regenerate the SH signals. In some examples, the renderer may be just a single matrix (frequency independent) and one which has an inverse counter-part matrix such that the R1×R1_inv=Identity matrix. These renderers exist for geometries described by T-Design or Platonic Solids. The loudspeaker feeds generated by the renderer (R1) may be coded using 'off-the-shelf' audio coders that will be modified by spatial information gleaned/analyzed from the SHC. In some instances, the techniques may take usual audio-coding approaches whereby, one or more of inter-channel level/time/correlation between the speaker feeds are maintained. Compression is used to pack more channels into the bits allocated for a single channel, etc.

At the decoder, the techniques may enable the decoder to recover the speaker feeds and put them through the INVERSE-RENDERER (R1_inv) to retrieve the original SHC. These SHC may be fed into another renderer (R2) meant to cater for the local speaker geometry. Typically, the techniques provide that the number of speaker feeds generated at the output of R1 is dense relative to the number of speakers ever likely to be at the output of Renderer R2. In other words, a much higher number of speakers than the actual number of speakers ever likely to be at the output of the R2 renderer is assumed when rendering the first multi-channel audio data.

It is to be recognized that depending on the example, certain acts or events of any of the techniques described herein can be performed in a different sequence, may be added, merged, or left out altogether (e.g., not all described acts or events are necessary for the practice of the techniques). Moreover, in certain examples, acts or events may be performed concurrently, e.g., through multi-threaded processing, interrupt processing, or multiple processors, rather than sequentially.

Figure 11:
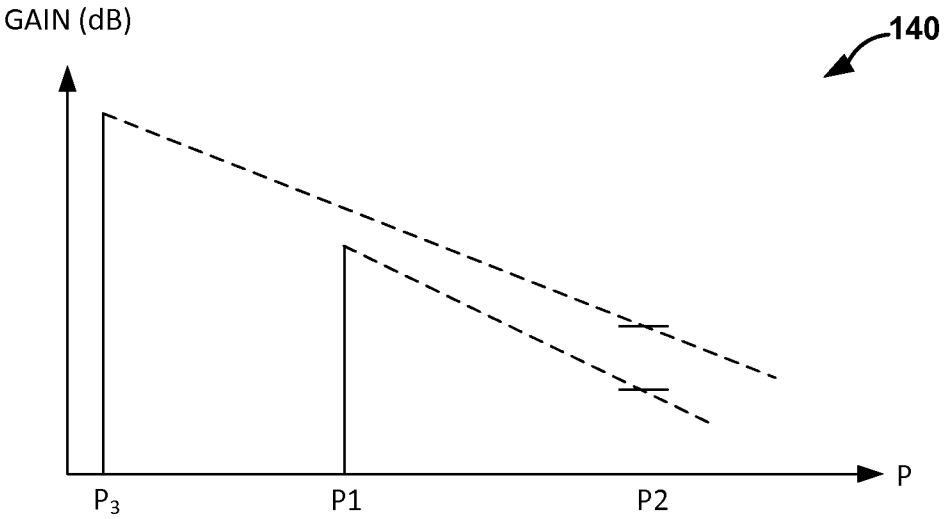
FIG. 11 is a diagram illustrating various aspects of the spatial masking techniques described in this disclosure.

FIG. 11 is a diagram illustrating various aspects of the spatial masking techniques described in this disclosure. In the example of FIG. 11, a graph 110 includes an x-axis denoting points in three-dimensional space within the sound field expressed as SHC. The y-axis of graph 110 denotes gain in decibels. The graph 110 depicts how spatial masking threshold is computed for point two ($P_2$) at a certain given frequency (e.g., frequency $f_1$). The spatial masking threshold may be computed as a sum of the energy of every other point (from the perspective of $P_2$). That is, the dashed lines represent the masking energy of point one ($P_1$) and point three ($P_3$) from the perspective of $P_2$. The total amount of energy may express the spatial masking threshold. Unless $P_2$ has an energy greater than the spatial masking threshold, SHC for $P_2$ need not be sent or otherwise encoded. Mathematically, the spatial masking ($SM_{th}$) threshold may be computed in accordance with the following equation:

$$SM_{th} = \sum_{i=1}^{n} E_{p_i}$$

where $E_{p_i}$ denotes the energy at point $P_i$. A spatial masking threshold may be computed for each point from the perspective of that point and for each frequency (or frequency bin which may represent a band of frequencies).

The spatial analysis unit 18 shown in the example of FIG. 4A may, as one example, compute the spatial masking threshold in accordance with the above equation so as to potentially reduce the size of the resulting bitstream. In some instances, this spatial analysis performed to compute the spatial masking thresholds may be performed with a separate masking block on the channels 22 and fed back into the audio encoding unit 16. While the graph 110 depicts the dB domain, the techniques may also be performed in the spatial domain.

In some examples, the spatial masking threshold may be used with a temporal (or, in other words, simultaneous) masking threshold. Often, the spatial masking threshold may be added to the temporal masking threshold to generate an overall masking threshold. In some instances, weights are applied to the spatial and temporal masking thresholds when generating the overall masking threshold. These threshold may be expressed as a function of ratios (such as a signal-to-noise ratio (SNR)). The overall threshold may be used by a bit allocator when allocating bits to each frequency bin. The audio encoding unit 16 of FIG. 4A may represent in one form a bit allocator that allocates bits to frequency bins using one or more of the spatial masking thresholds, the temporal masking threshold or the overall masking threshold.

Figure 12:
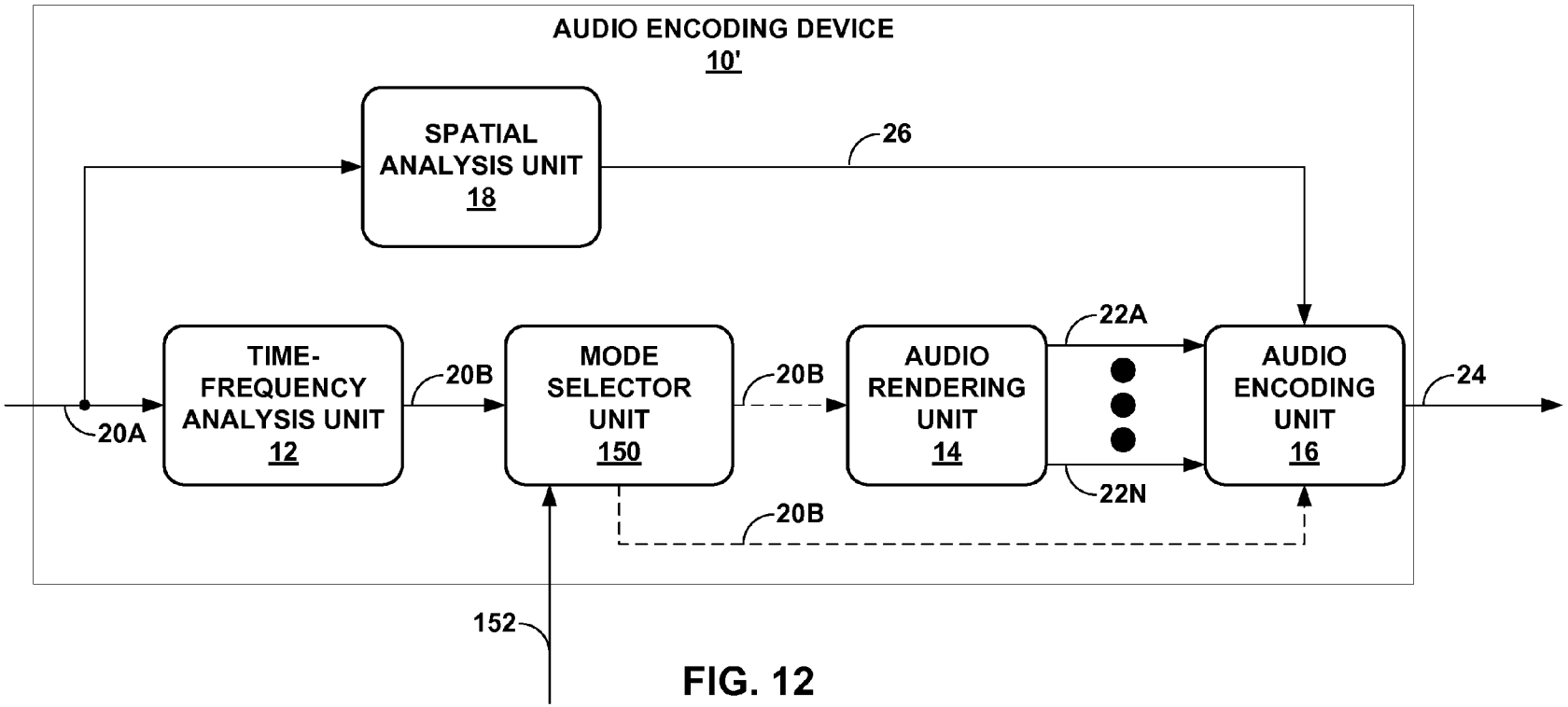
FIG. 12 is a block diagram illustrating a variation of the audio encoding device shown in the example of FIG. 4A in which different forms of generating the bitstream may be performed in accordance with various aspects of the techniques described in this disclosure.

FIG. 12 is a block diagram illustrating a variation of the audio encoding device shown in the example of FIG. 4A in which different forms of generating the bitstream 24 may be performed in accordance with various aspects of the techniques described in this disclosure. As shown in the example of FIG. 12, the variation of the audio encoding device 10 is denoted as an audio encoding device 10'. The audio encoding device 10' is similar to the audio encoding device 10 of FIG. 4A in that the audio encoding device 10' includes similar units, i.e., the time-frequency analysis unit 12, the audio rendering unit 14, the audio encoding unit 16 and the spatial analysis unit 18 in the example of FIG. 12.

The audio encoding device 10', however, also includes a mode selector unit 150, which represents a unit that determines whether to render the SHC 20B prior to encoding the channels 22 or transmit the SHC 20B directly to the audio encoding unit 16 without first rendering the SHC20B to the channels 22. Mode selector unit 150 may receive a target bitrate 152 as an input from a user, another device or via any other way by which the target bitrate 152 may be input. The target bitrate 152 may represent data defining a bitrate or level of compression for the bitstream 24.

In one example, for higher bitrates specified by the bitrate 152, the mode selector unit 150 may determine that the SHC 20B are to be audio encoded directly by audio encoding unit 16 using the spatial masking aspects of the techniques described in this disclosure. One example of higher bitrates may be bitrates equal to or above 256 Kilobits per second (Kbps). Thus, for bitrates such as 256 Kbps, 512 Kbps and/or 1.2 megabits per second (Mbps) (where 256 Kbps may, in this example represent a threshold bitrate used to determine the higher bitrates from the lower bitrates), the audio encoding unit 16 may operate directly on the SHC 20B and the SHC 20B are not rendered to the channels 22 by audio rendering unit 14.

For lower bitrates specified by the bitrate 152, the mode selector unit 150 may determine that the SHC 20B are to be first rendered by the audio rendering unit 14 to generate the channels 22 and then subsequently encoded by the audio encoding unit 16. In this instance, the audio encoding unit 16 may perform the spatial masking techniques with respect to the first channel, while the remaining channels undergo parametric encoding, such as that performed in accordance with MPEG surround and other parametric inter-channel encoding schemes.

The audio encoding unit 16 may specify (either in encoded or non-encoded form) the mode selected by mode selector unit 150 in the bitstream so that the decoding device may determine whether parametric inter-channel encoding was performed when generating the bitstream 24. While not shown in detail, the audio decoding device 30 may be modified in a similar manner to that of the audio encoding device 10' (where such audio decoding device 30 may be referred to as the audio decoding device 30'). This audio decoding device 30' may likewise include a mode selector unit similar to mode selector unit 150 that determines whether to output either the channels 22 to the inverse audio rendering unit 34 or the SHC 20B to the inverse time-frequency analysis unit 36. In some instances, this mode may be inferred from the target bitrate 152 to which the bitstream 24 corresponds (where this target bitrate 152 may be specified in the bitstream 24 and effectively represents the mode given that the audio decoding device 30' may infer this mode from the target bitrate 152).

In this respect, the techniques described in this disclosure may enable the audio encoding device 10' to perform a method of compressing audio data. In performing this method, the audio encoding device 10' may determine a target bitrate for a bitstream representative of the compressed audio data and perform spatial analysis based on a plurality of spherical harmonic coefficients that describe a sound field of the audio data in three dimensions to identify a spatial masking threshold. Based on the target bitrate, the audio encoding device 10' may perform either i) parametric inter-channel audio encoding and spatial masking using the spatial masking threshold or ii) the spatial masking using the spatial masking threshold without performing the parametric inter-channel audio encoding to generate a bitstream representative of the compressed audio data.

In some instances, when performing either i) the parametric inter-channel audio encoding and the spatial masking using the spatial masking threshold or ii) the spatial masking using the spatial masking threshold without performing the parametric inter-channel audio encoding, the audio encoding device 10' may determine that the target bitrate is below a threshold bitrate, and in response to determining that the target bitrate is below the threshold bitrate, perform the parametric inter-channel audio encoding and the spatial masking using the spatial masking threshold to generate the bitstream. The threshold bitrate, may for example, be equal to 256 Kilobits per second (Kbps).

In some instances, when performing either i) the parametric inter-channel audio encoding and the spatial masking using the spatial masking threshold or ii) the spatial masking using the spatial masking threshold without performing the parametric inter-channel audio encoding, the audio encoding device 10' may determine that the target bitrate is equal to or exceeds a threshold bitrate, and in response to determining that the target bitrate is equal to or exceeds the threshold bitrate, performing the spatial masking using the spatial masking threshold without performing the parametric inter-channel audio encoding to generate the bitstream.

In some instances, the audio encoding device 10' may further render the plurality of spherical harmonic coefficients to multi-channel audio data. When performing either i) the parametric inter-channel audio encoding and the spatial masking using the spatial masking threshold or ii) the spatial masking using the spatial masking threshold without performing the parametric inter-channel audio encoding, the audio encoding device 10' may determine that the target bitrate is below a threshold bitrate, and in response to determining that the target bitrate is below the threshold bitrate, performing the spatial masking using the spatial masking threshold with respect to one or more base channels of the multi-channel audio data and performing the parametric inter-channel audio encoding with respect to the multi-channel audio data to generate the bitstream. Again, the threshold bitrate may be equal to 256 Kilobits per second (Kbps).

In some instances, the audio encoding device 10' may also allocate bits in the bitstream for either a time-based representation of the audio data or a frequency-based representation of the audio data based on the spatial masking threshold.

In some instances, the parametric inter-channel audio encoding comprises a moving picture experts group (MPEG) Surround.

Moreover, the techniques described in this disclosure may enable the audio encoding device 10' to perform a method of compressing multi-channel audio data. In performing this method, the audio encoding device 10' may perform spatial analysis based on a plurality of spherical harmonic coefficients that describe a sound field of the multi-channel audio data in three dimensions to identify a spatial masking threshold, and render the spherical harmonic coefficients to generate the multi-channel audio data. The audio encoding device 10' may also perform spatial masking with respect to one or more base channels of the multi-channel audio data using the spatial masking threshold, and perform parametric inter-channel audio encoding with respect to the multi-channel audio data, including the spatially masked one or more base channels of the multi-channel audio data, to generate a bitstream.

In some instances, the audio encoding device 10' may determine a target bitrate at which to encode the multi-channel audio data as the bitstream. In this context, when performing the spatial masking and the parametric inter-channel audio encoding, the audio encoding device 10', when the target bitrate is less than a threshold bitrate, performs the spatial masking with respect to the one or more base channels of the multi-channel audio data and performing the parametric inter-channel audio encoding with respect to the multi-channel audio data, including the spatially masked one or more base channels of the multi-channel audio data, to generate the bitstream.

In some instances, the threshold bitrate is equal to 256 Kilobits per second (Kbps). In some instances, this threshold bitrate is specified by a user or application. That is, this threshold bitrate may be configurable or may be statically set. In some instances, the target bitrate is equal to 128 Kilobits per second (Kbps). In some instances, the parametric inter-channel audio encoding comprises a moving picture experts group (MPEG) Surround.

In some instances, the audio encoding device 10' also performs temporal masking with respect to the multi-channel audio data using a temporal masking threshold.

Additionally, various aspects of the techniques may further (or alternatively) enable the audio encoding device 10' to perform a method of compressing audio data. In performing this method, the audio encoding device 10' may perform spatial analysis based on a plurality of spherical harmonic coefficients that describe a sound field of the audio data in three dimensions to identify a spatial masking threshold, perform spatial masking with respect to the plurality of spherical harmonic coefficients using the spatial masking threshold, and generate a bitstream that includes the plurality of spatially masked spherical harmonic coefficients.

The audio encoding device 10' may, in some instances, determine a target bitrate at which to encode the multi-channel audio data as the bitstream. When performing the spatial masking, the audio encoding device 10' may, when the target bitrate is equal to or greater than a threshold bitrate, perform the spatial masking with respect to the plurality of spherical harmonic coefficients. In some instances, the threshold bitrate is equal to 256 Kilobits per second (Kbps). The target bitrate is equal or greater than 256 Kilobits per second (Kbps) in these instances.

In some instances, the audio encoding device 10' may further perform temporal masking with respect to plurality of spherical harmonic coefficients using a temporal masking threshold.

While described above as performing spatial masking analysis with respect to the spherical harmonic coefficients, the techniques described above with respect to the example of FIG. 12 may also be performed in the so-called "channel domain" similar to how spatial analysis is performed in the channel domain by the audio encoding device 11 of FIG. 4B. Accordingly, the techniques should not be limited in this respect to the example of FIG. 12.

Figure 13:
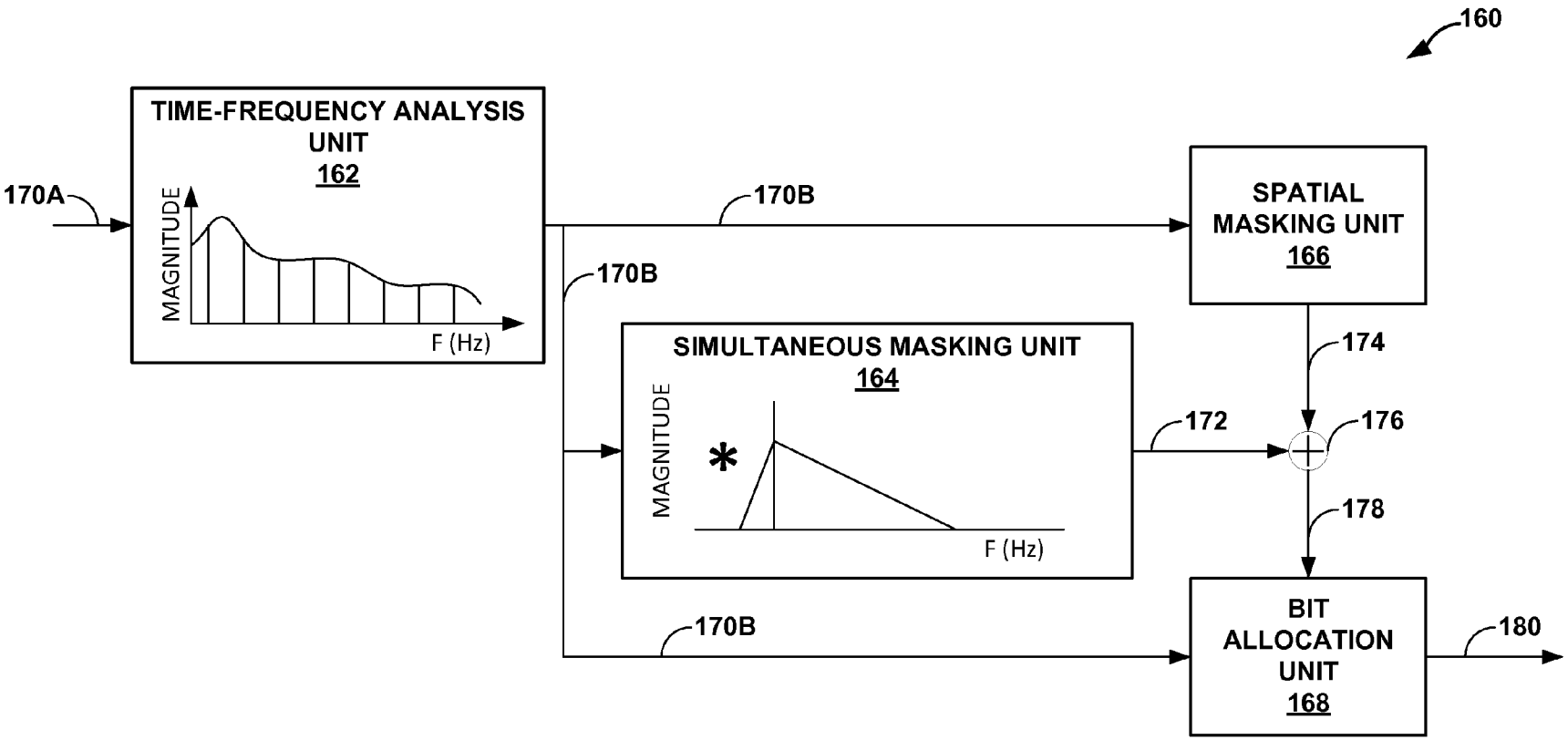
FIG. 13 is a block diagram illustrating an exemplary audio encoding device that may perform various aspects of the techniques described in this disclosure.

FIG. 13 is a block diagram illustrating an exemplary audio encoding device 160 that may perform various aspects of the techniques described in this disclosure. As shown in the example of FIG. 13, the audio encoding device 160 may include a time-frequency analysis unit 162, a simultaneous masking unit 164, a spatial masking unit 166 and a bit allocation unit 168. The time-frequency unit 162 may be similar or substantially similar to time-frequency analysis unit 12 of the audio encoding device 10 shown in the example of FIG. 4A. The time-frequency unit 162 may receive SHC 170A, transforming the SHC 170A from the time domain to the frequency domain (where the frequency domain version of SHC 170A is denoted as "SHC 170B").

The simultaneous masking unit 164 represents a unit that performs a simultaneous analysis (which may also be referred to as a "temporal analysis") of the SHC 170B to determine one or more simultaneous masking thresholds 172. The simultaneous masking unit 164 may evaluate the sound field described by the SHC 170B to identify, as one example, concurrent but separate sounds. When there is a large difference in gain between two concurrent sounds, typically only the loudest sound (which may represent the sound with the largest energy) need be accurately represented while the comparably quieter sound may be less accurately represented (which is typically done by allocating less bits to the comparably quite sound). In any event, the simultaneous making unit 164 may output one or more simultaneous masking thresholds 172 (often specified on a frequency bin by frequency bin basis).

The spatial masking unit 166 may represent a unit that performs spatial analysis with respect to the SHC 170B and in accordance with various aspects of the techniques described above to determine one or more spatial masking thresholds 174 (which likewise may be specified on a frequency bin by frequency bin basis). The spatial masking unit 166 may output the spatial masking thresholds 174, which are combined by a combiner 176 with the temporal masking thresholds 172 to form overall masking thresholds 178. The combiner 176 may add or perform any other form of mathematical operation to combine the temporal masking thresholds 172 with the spatial masking thresholds 174 to generate the overall masking thresholds 178.

The bit allocation unit 168 represents any unit capable of allocating bits in a bitstream 180 representative of audio data based on a threshold, such as the overall masking thresholds 178. The bit allocation unit 168 may allocate bits using the various thresholds 178 to identify when to allocate more or less bits. Commonly, the bit allocation unit 168 operates in multiple so-called "passes," where the bit allocation unit 168 allocates bits for representing the SHC 170B in the bitstream 180 during a first initial bit allocation pass. The bit allocation unit 168 may allocate bits conservatively during this first pass so that a bit budget (which may correspond to the target bitrate) is not exceeded. During second and possibly subsequent bit allocation passes, the bit allocation unit 168 may allocate any bits remaining in a bit budget (which may correspond to a target bitrate) to further refine how various frequency bins of the SHC 170B are represented in the bitstream 180. While described as allocating bits based on the overall masking thresholds 178, the bit allocation unit 168 may allocate bits based on any one or more of the spatial masking thresholds 174, the temporal masking thresholds 172 and the overall masking thresholds 178.

Figure 14:
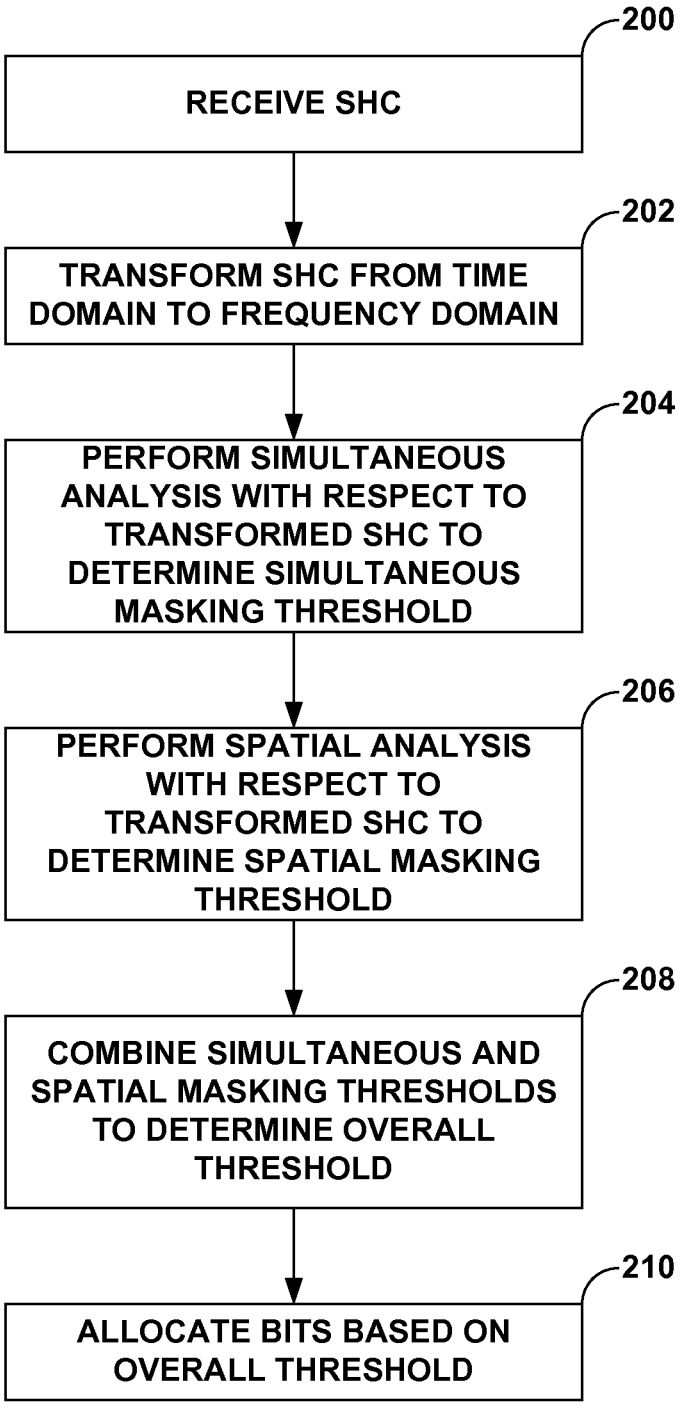
FIG. 14 is a flowchart illustrating exemplary operation of an audio decoding device in performing various aspects of the techniques described in this disclosure.

FIG. 14 is a flowchart illustrating exemplary operation of an audio decoding device, such as the audio encoding device 160 shown in the example of FIG. 13, in performing various aspects of the techniques described in this disclosure. In operation, the time-frequency unit 162 of the audio decoding may receive SHC 170A (200), transforming the SHC 170A from the time domain to the frequency domain (where the frequency domain version of SHC 170A is denoted as "SHC 170B") (202).

The simultaneous masking unit 164 of the audio encoding device 160 may then perform a simultaneous analysis (which may also be referred to as a "temporal analysis") of the SHC 170B to determine one or more simultaneous masking thresholds 172 (204). The simultaneous making unit 164 may output one or more simultaneous masking thresholds 172 (often specified on a frequency bin by frequency bin basis).

The spatial masking unit 166 of the audio encoding device 160 may perform a spatial analysis with respect to the SHC 170B and in accordance with various aspects of the techniques described above to determine one or more spatial masking thresholds 174 (which likewise may be specified on a frequency bin by frequency bin basis) (206). The spatial masking unit 166 may output the spatial masking thresholds 174, which are combined by a combiner 176 with the simultaneous masking thresholds 172 (which may also be referred to as "temporal masking thresholds 172") to form overall masking thresholds 178 (208). The combiner 176 may add or perform any other form of mathematical operation to combine the temporal masking thresholds 172 with the spatial masking thresholds 174 to generate the overall masking thresholds 178.

The bit allocation unit 168 represents any unit capable of allocating bits in a bitstream 180 representative of audio data based on a threshold, such as the overall masking thresholds 178. The bit allocation unit 168 may allocate bits using the various thresholds 178 to identify when to allocate more or less bits (210) in the manner described above. Again, while described as allocating bits based on the overall masking thresholds 178, the bit allocation unit 168 may allocate bits based on any one or more of the spatial masking thresholds 174, the temporal masking thresholds 172 and the overall masking thresholds 178.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various embodiments of the techniques have been described. These and other aspects of the techniques are within the scope of the following claims.

The invention claimed is:

1. A method of compressing multi-channel audio data comprising:

performing a spatial analysis based on a plurality of spherical harmonic coefficients that describe a three-dimensional sound field to identify a spatial masking threshold;

rendering multi-channel audio data from the plurality of spherical harmonic coefficients, wherein the multi-channel audio data is rendered for a dense speaker geometry such that the multi-channel audio data has a number of channels greater than a number of channels for playback via one or more speakers; and compressing the rendered multi-channel audio data based on the identified spatial masking threshold to generate a bitstream.

2. The method of claim 1, further comprising determining a target bitrate for the bitstream, wherein compressing the rendered multi-channel audio data comprises performing, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

3. The method of claim 2, wherein performing either i) the parametric inter-channel audio encoding and the spatial masking using the spatial masking threshold or ii) the spatial masking using the spatial masking threshold without performing the parametric inter-channel audio encoding comprises:

determining that the target bitrate is below a threshold bitrate; and in response to determining that the target bitrate is below the threshold bitrate, performing the parametric inter-channel audio encoding and the spatial masking using the spatial masking threshold to generate the bitstream.

4. The method of claim 2, wherein performing either i) the parametric inter-channel audio encoding and the spatial masking using the spatial masking threshold or ii) the spatial masking using the spatial masking threshold without performing the parametric inter-channel audio encoding comprises:

determining that the target bitrate is below a threshold bitrate; and in response to determining that the target bitrate is below the threshold bitrate, performing the spatial masking using the spatial masking threshold with respect to one or more base channels of the multi-channel audio data and performing the parametric inter-channel audio encoding with respect to the multi-channel audio data to generate the bitstream.

5. The method of claim 1, wherein rendering the multi-channel audio data from the spherical harmonic coefficients comprises rendering 32 channels of the multi-channel audio data for 32 speakers in the dense speaker geometry from the spherical harmonic coefficients.

6. The method of claim 1, wherein the dense speaker geometry comprises a dense T-design speaker geometry, and wherein rendering the multi-channel audio data from the spherical harmonic coefficients comprises rendering 32 channels of the multi-channel audio data corresponding to 32 speakers arranged in the dense T-design speaker geometry from the spherical harmonic coefficients.

7. The method of claim 1, wherein compressing the rendered multi-channel audio data comprises allocating bits in the bitstream for either a time-based representation of the multi-channel audio data or a frequency-based representation of the multi-channel audio data based on the spatial masking threshold.

8. The method of claim 1, wherein compressing the rendered multi-channel audio data comprises allocating bits in the bitstream for either a time-based representation of the multi-channel audio data or a frequency-based representation of the multi-channel audio data based on the spatial masking threshold and a temporal masking threshold.

9. The method of claim 1, wherein compressing the rendered multi-channel audio data comprises performing entropy encoding based on the identified spatial masking threshold.

10. The method of claim 1, further comprising transforming the plurality of spherical harmonic coefficients from the time domain to the frequency domain so as to generate a transformed plurality of spherical harmonic coefficients, wherein rendering the multi-channel audio data comprises rendering the multi-channel audio data from the transformed plurality of spherical harmonic coefficients.

11. An audio encoding device comprising:

one or more processors configured to perform a spatial analysis based on a plurality of spherical harmonic coefficients that describe a three-dimensional sound field to identify spatial masking thresholds, render multi-channel audio data from the plurality of spherical harmonic coefficients, wherein the multi-channel audio data is rendered for a dense speaker geometry such that the multi-channel audio data has a number of channels greater than a number of channels for playback via one or more speakers, and compress the rendered multi-channel audio data based on the identified spatial masking thresholds to generate a bitstream.

12. The audio encoding device of claim 11, wherein the one or more processors are further configured to determine a target bitrate for the bitstream, and wherein the one or more processors are configured to perform, based on the target bitrate, either i) parametric inter-channel audio encoding and spatial masking using the spatial masking threshold or ii) the spatial masking using the spatial masking threshold without performing the parametric inter-channel audio encoding to generate a bitstream representative of the compressed audio data.

13. The audio encoding device of claim 12, wherein the one or more processors are configured to determine that the target bitrate is below a threshold bitrate, and in response to determining that the target bitrate is below the threshold bitrate, perform the parametric inter-channel audio encoding and the spatial masking using the spatial masking threshold to generate the bitstream.

14. The audio encoding device of claim 12, wherein the one or more processors are configured to determine that the target bitrate is below a threshold bitrate, and in response to determining that the target bitrate is below the threshold bitrate, perform the spatial masking using the spatial masking threshold with respect to one or more base channels of the multi-channel audio data and performing the parametric inter-channel audio encoding with respect to the multi-channel audio data to generate the bitstream.

15. The audio encoding device of claim 11, wherein the one or more processors are further configured to render 32 channels of the multi-channel audio data for 32 speakers arranged in the dense speaker geometry from the spherical harmonic coefficients.

16. The audio encoding device of claim 11, wherein the dense speaker geometry comprises a dense T-design speaker geometry, and wherein the one or more processors are further configured to render 32 channels of the multi-channel audio data corresponding to 32 speakers arranged in the dense T-design from the spherical harmonic coefficients.

17. The audio encoding device of claim 11, wherein the one or more processors are further configured to allocate bits in the bitstream for either a time-based representation of the multi-channel audio data or a frequency-based representation of the multi-channel audio data based on the spatial masking threshold.

18. The audio encoding device of claim 11, wherein the one or more processors are further configured to allocate bits in the bitstream for either a time-based representation of the multi-channel audio data or a frequency-based representation of the multi-channel audio data based on the spatial masking threshold and a temporal masking threshold.

19. The audio encoding device of claim 11, wherein the one or more processors are further configured to perform entropy encoding based on the identified spatial masking thresholds.

20. The audio encoding device of claim 11, wherein the one or more processors are further configured to transform the plurality of spherical harmonic coefficients from the time domain to the frequency domain so as to generate a transformed plurality of spherical harmonic coefficients, and, when rendering the multi-channel audio data, render the multi-channel audio data from the transformed plurality of spherical harmonic coefficients.

21. An audio encoding device comprising:

means for performing a spatial analysis based on a plurality of spherical harmonic coefficients that describe a three-dimensional sound field to identify a spatial masking threshold;

means for rendering multi-channel audio data from the plurality of spherical harmonic coefficients, wherein the multi-channel audio data is rendered for a dense speaker geometry such that the multi-channel audio data has a number of channels greater than a number of channels for playback via one or more speakers; and means for compressing the rendered multi-channel audio data based on the identified spatial masking threshold to generate a bitstream.

22. A non-transitory computer-readable storage medium having stored thereon instructions that, when executed, cause one or more processors of an audio encoding device to:

perform a spatial analysis based on a plurality of spherical harmonic coefficients that describe a three-dimensional sound field to identify a spatial masking threshold;

render multi-channel audio data from the plurality of spherical harmonic coefficients, wherein the multi-channel audio data is rendered for a dense speaker geometry such that the multi-channel audio data has a number of channels greater than a number of channels for playback via one or more speakers; and compress the rendered multi-channel audio data based on the identified spatial masking thresholds to generate a bitstream.

23. A method comprising:

decoding a bitstream to generate first multi-channel audio data having a plurality of channels corresponding to speakers arranged in a defined speaker geometry;

performing an inverse rendering process with respect to the generated multi-channel audio data to generate a plurality of spherical harmonic coefficients; and rendering second multi-channel audio data having a plurality of channels corresponding to speakers arranged in a local speaker geometry based on the plurality of spherical harmonic coefficients, wherein the plurality of channels corresponding the speakers arranged in the defined speaker geometry has a number of channels greater than a number of channels of the plurality of channels corresponding to the speakers arranged in the local speaker geometry.

24. The method of claim 23, further comprising determining a target bitrate for the bitstream, wherein decoding the bitstream comprises performing, based on the target bitrate, parametric inter-channel audio decoding with respect to the bitstream to generate the first multi-channel audio data.

25. The method of claim 24, wherein performing the parametric inter-channel audio decoding comprises:

determining that the target bitrate is below a threshold bitrate; and in response to determining that the target bitrate is below the threshold bitrate, performing the parametric inter-channel audio decoding with respect to the bitstream to generate the first multi-channel audio data.

26. The method of claim 25, wherein the threshold bitrate is equal to 256 Kilobits per second (Kbps).

27. The method of claim 23, wherein performing the inverse rendering process comprises performing the inverse rendering process with respect to 32 channels arranged in the dense speaker geometry of the first multi-channel audio data that correspond to 32 speakers to generate the plurality of spherical harmonic coefficients.

28. The method of claim 23, wherein the dense speaker geometry comprises a dense T-design speaker geometry, and wherein performing the inverse rendering process comprises performing the inverse rendering process with respect to 32 channels of the first multi-channel audio data that correspond to 32 speakers arranged in the dense T-design to generate the plurality of spherical harmonic coefficients.

29. The method of claim 23, further comprising transforming the plurality of spherical harmonic coefficients from the frequency domain to the time domain so as to generate a transformed plurality of spherical harmonic coefficients, wherein rendering the second multi-channel audio data comprises rendering the second multi-channel audio data having the plurality of channels corresponding to the speakers arranged in the local speaker geometry based on the transformed plurality of spherical harmonic coefficients.

30. The method of claim 23, wherein rendering the second multi-channel audio data comprises performing a transform on the plurality of spherical harmonic coefficients to generate the second multi-channel audio data having the plurality of channels corresponding to the speakers arranged in the local speaker geometry based on the plurality of spherical harmonic coefficients.

31. The method of claim 30, wherein the plurality of channels of the second multi-channel audio data comprise a plurality of virtual channels corresponding to virtual speakers arranged in a geometry different from the local speaker geometry, and wherein rendering the second multi-channel audio data further comprises performing panning on the plurality of virtual loudspeaker channels to produce the plurality of channels of the second multi-channel audio data corresponding to the speakers arranged in the local speaker geometry.

32. The method of claim 31, wherein performing panning comprises performing vector base amplitude panning on the plurality of virtual channels to produce the plurality of channel of the second multi-channel audio data.

33. The method of claim 32, wherein each of the plurality of virtual channels is associated with a corresponding different defined region of space.

34. The method of claim 33, wherein the different defined regions of space are defined in one or more of an audio format specification and an audio format standard.

35. An audio decoding device comprising:

one or more processors configured to decode a bitstream to generate first multi-channel audio data having a plurality of channels corresponding to speakers arranged in a first speaker geometry, perform an inverse rendering process with respect to the generated multi-channel audio data to generate a plurality of spherical harmonic coefficients, and render second multi-channel audio data having a plurality of channels corresponding to speakers arranged in a local speaker geometry based on the plurality of spherical harmonic coefficients, wherein the plurality of channels corresponding the speakers arranged in the defined speaker geometry has a number of channels greater than a number of channels of the plurality of channels corresponding to the speakers arranged in the local speaker geometry.

36. The audio decoding device of claim 35, wherein the one or more processors are further configured to determine a target bitrate for the bitstream, wherein the one or more processors are configured to perform, based on the target bitrate, parametric inter-channel audio decoding with respect to the bitstream to generate the first multi-channel audio data.

37. The audio decoding device of claim 36, wherein the one or more processors are configured to determine that the target bitrate is below a threshold bitrate, and in response to determining that the target bitrate is below the threshold bitrate, perform the parametric inter-channel audio decoding with respect to the bitstream to generate the first multi-channel audio data.

38. The audio decoding device of claim 37, wherein the threshold bitrate is equal to 256 Kilobits per second (Kbps).

39. The audio decoding device of claim 35, wherein the one or more processors are configured to, when performing the inverse rendering process, perform the inverse rendering process with respect to 32 channels of the first multi-channel audio data that correspond to 32 speakers arranged in the dense speaker geometry to generate the plurality of spherical harmonic coefficients.

40. The audio decoding device of claim 35, wherein the dense speaker geometry comprises a dense T-design speaker geometry, and wherein the one or more processors are configured to, when performing the inverse rendering process, perform the inverse rendering process with respect to 32 channels of the first multi-channel audio data that correspond to 32 speakers arranged in the dense T-design to generate the plurality of spherical harmonic coefficients.

41. The audio decoding device of claim 35, wherein the one or more processors are configured to transform the plurality of spherical harmonic coefficients from the frequency domain to the time domain so as to generate a transformed plurality of spherical harmonic coefficients, wherein the one or more processors are configured to, when rendering the second multi-channel audio data, render the second multi-channel audio data having the plurality of channels corresponding to the speakers arranged in the local speaker geometry based on the transformed plurality of spherical harmonic coefficients.

42. The audio decoding device of claim 35, wherein the one or more processors are configured to, when rendering the second multi-channel audio data, perform a transform on the plurality of spherical harmonic coefficients to generate the second multi-channel audio data having the plurality of channels corresponding to the speakers arranged in the local speaker geometry based on the plurality of spherical harmonic coefficients.

43. The audio decoding device of claim 42, wherein the plurality of channels of the second multi-channel audio data comprise a plurality of virtual channels corresponding to virtual speakers arranged in a geometry different from the local speaker geometry, wherein the one or more processors are configured to, when rendering the second multi-channel audio data, perform panning on the plurality of virtual loudspeaker channels to produce the plurality of channels of the second multi-channel audio data corresponding to the speakers arranged in the local speaker geometry.

44. The audio decoding device of claim 43, wherein the one or more processors are configured to, when performing panning, perform vector base amplitude panning on the plurality of virtual channels to produce the plurality of channel of the second multi-channel audio data.

45. The audio decoding device of claim 44, wherein each of the plurality of virtual channels is associated with a corresponding different defined region of space.

46. The audio decoding device of claim 45, wherein the different defined regions of space are defined in one or more of an audio format specification and an audio format standard.

47. An audio decoding device comprising:

means for decoding a bitstream to generate first multi-channel audio data having a plurality of channels corresponding to speakers arranged in a first speaker geometry;

means for performing an inverse rendering process with respect to the generated multi-channel audio data to generate a plurality of spherical harmonic coefficients; and means for rendering second multi-channel audio data having a plurality of channels corresponding to speakers arranged in a local speaker geometry based on the plurality of spherical harmonic coefficients, wherein the plurality of channels corresponding the speakers arranged in the defined speaker geometry has a number of channels greater than a number of channels of the plurality of channels corresponding to the speakers arranged in the local speaker geometry.

48. A non-transitory computer-readable storage medium having stored thereon instructions that, when executed, cause one or more processors of an audio decoding device to:

decode a bitstream to generate first multi-channel audio data having a plurality of channels corresponding to speakers arranged in a first speaker geometry;

perform an inverse rendering process with respect to the generated multi-channel audio data to generate a plurality of spherical harmonic coefficients; and render second multi-channel audio data having a plurality of channels corresponding to speakers arranged in a local speaker geometry based on the plurality of spherical harmonic coefficients, wherein the plurality of channels corresponding the speakers arranged in the defined speaker geometry has a number of channels greater than a number of channels of the plurality of channels corresponding to the speakers arranged in the local speaker geometry.

* * * * *